US009328598B2

(12) United States Patent
Phi et al.

(10) Patent No.: US 9,328,598 B2
(45) Date of Patent: May 3, 2016

(54) SYSTEMS AND METHODS FOR STIMULATING A PLURALITY OF ZONES OF A SUBTERRANEAN FORMATION

(71) Applicants: Manh V. Phi, Fountain Valley, CA (US); Stuart R. Keller, Houston, TX (US); Chris E. Shuchart, Missouri City, TX (US)

(72) Inventors: Manh V. Phi, Fountain Valley, CA (US); Stuart R. Keller, Houston, TX (US); Chris E. Shuchart, Missouri City, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/391,158

(22) PCT Filed: Jun. 12, 2013

(86) PCT No.: PCT/US2013/045453

§ 371 (c)(1),
(2) Date: Oct. 7, 2014

(87) PCT Pub. No.: WO2013/191991

PCT Pub. Date: Dec. 27, 2013

(65) Prior Publication Data

US 2015/0129219 A1 May 14, 2015

Related U.S. Application Data

(60) Provisional application No. 61/662,736, filed on Jun. 21, 2012.

(51) Int. Cl.
*E21B 43/25* (2006.01)
*E21B 23/14* (2006.01)
(Continued)

(52) U.S. Cl.
CPC ..... *E21B 43/25* (2013.01); *E21B 23/14* (2013.01); *E21B 33/124* (2013.01);
(Continued)

(58) Field of Classification Search
CPC ..... E21B 43/02; E21B 43/08; E21B 43/10; E21B 43/11; E21B 43/16; E21B 43/25
See application file for complete search history.

(56) References Cited

U.S. PATENT DOCUMENTS 5,832,998 A 11/1998 Decker et al.
2001/0050172 A1* 12/2001 Tolman ..... E21B 17/203 166/297

(Continued)

OTHER PUBLICATIONS

Jackson, A. et al, "Completion and Stimulation Challenges and Solutions for Extended-Reach Multizone Horizontal Wells in Carbonate Formations", SPE 141812, Sep. 2011, pp. 1-11, Manama, Bahrain.

(Continued)

*Primary Examiner* — Elizabeth Gitlin
(74) *Attorney, Agent, or Firm* — ExxonMobil Upstream Research-Law Department

(57) ABSTRACT

Systems and methods for stimulating a plurality of zones of a subterranean formation to increase production of reservoir fluids therefrom. The subterranean formation contains a well that includes a liner that defines a liner conduit, and the systems and methods include stimulating the plurality of zones with a stimulation assembly that is present within the liner conduit without requiring removal of the stimulation assembly from the liner conduit. The stimulation assembly includes a perforation device, which is configured to selectively form one or more perforations in a plurality of portions of the liner, and a resettable sealing device, which is configured to fluidly isolate the plurality of portions of the liner from a plurality of respective downhole portions of the liner. The fluid isolation provides for selective introduction of a stimulant fluid to a selected zone of the subterranean formation that is associated with a corresponding portion of the liner.

33 Claims, 7 Drawing Sheets

(51) Int. Cl.

| | |
|---|---|
| ***E21B 43/11*** | (2006.01) |
| ***E21B 43/14*** | (2006.01) |
| ***E21B 33/124*** | (2006.01) |
| ***E21B 33/128*** | (2006.01) |
| ***E21B 43/08*** | (2006.01) |
| ***E21B 43/16*** | (2006.01) |
| ***E21B 47/12*** | (2012.01) |
| ***F04B 47/00*** | (2006.01) |
| *E21B 43/26* | (2006.01) |

(52) U.S. Cl.

CPC ..... *E21B 33/1285* (2013.01); *E21B 43/08* (2013.01); *E21B 43/11* (2013.01); *E21B 43/14* (2013.01); *E21B 43/16* (2013.01); *E21B 47/122* (2013.01); *F04B 47/00* (2013.01); *E21B 43/26* (2013.01)

(56) References Cited

U.S. PATENT DOCUMENTS

| | | | |
|---|---|---|---|
| 2003/0183395 | A1 | 10/2003 | Jones |
| 2007/0051517 | A1 | 3/2007 | Surjaatmadja et al. |
| 2010/0155065 | A1 | 6/2010 | Misselbrook |
| 2012/0067582 | A1 | 3/2012 | Fincher |

OTHER PUBLICATIONS

Lonnes, S.B. et al, "Advanced Multizone Stimulation Technology", SPE 95778, Oct. 2005, pp. 1-7, Dallas, TX.

* cited by examiner

SYSTEMS AND METHODS FOR STIMULATING A PLURALITY OF ZONES OF A SUBTERRANEAN FORMATION

CROSS REFERENCE TO RELATED APPLICATIONS

This application is the National Stage of International Application No. PCT/US2013/045453, filed Jun. 12, 2013, which claims the benefit of U.S. Provisional Patent Application No. 61/662,736, filed Jun. 21, 2012, the disclosure of which is incorporated by reference.

FIELD OF THE DISCLOSURE

The present disclosure is directed generally to systems and methods for stimulating, via a well, a plurality of zones of a subterranean formation, and more particularly to systems and methods that utilize a stimulation system that includes a perforation device and a resettable sealing device to stimulate the plurality of zones without requiring removal of the stimulation system from the well.

BACKGROUND OF THE DISCLOSURE

A subterranean formation may be stimulated to increase a production rate of reservoir fluids therefrom. Stimulation of subterranean formations may be accomplished in a variety of ways, with the specific stimulation technique often being selected based upon the specific geological structures that are included within the subterranean formation and/or the specific reservoir fluids that may be removed therefrom. As an illustrative, non-exclusive example, oil shale formations may be stimulated through the use of hydraulic fracturing to create one or more fractures therein, with the fractures serving as fluid conduits for the removal of shale oil from the oil shale formation. As another illustrative, non-exclusive example, an acid solution may be supplied to a carbonate formation to dissolve a portion of the carbonate formation and create one or more fluid conduits therein.

Often, it may be desirable to stimulate a specific region, or zone, of the subterranean formation. As an illustrative, non-exclusive example, a well, which also may be referred to herein as a stimulation well, may be drilled into the subterranean formation and may be utilized to provide one or more stimulant fluids to the subterranean formation, such as to one or more pay zones thereof. As used herein, "pay zone" refers to a zone, or region, of a subterranean formation that includes one or more materials that are to be produced or otherwise removed from the subterranean formation. A portion of a wellbore that is associated with the well may be present within a pay zone of the subterranean formation, while a remainder of the wellbore may not be present within the pay zone; and it may be desirable to provide, or direct, stimulant fluids into the pay zone. Additionally or alternatively, it may be desirable to independently, systematically, and/or selectively provide the stimulant fluid to a plurality of regions, or zones, within the pay zone of the subterranean formation.

Historically, coiled tubing and/or ball and seat systems have been utilized to provide for the supply of stimulant fluids to specific, or desired, regions of the subterranean formation. However, these systems may be expensive to implement, time-consuming to utilize, may only provide for stimulation of a limited number of regions within the subterranean formation, may only provide for stimulation of specific predetermined regions of the subterranean formation and/or may not be effective when utilized in long wellbores. Thus, there exists a need for improved systems and methods for stimulating subterranean formations.

SUMMARY OF THE DISCLOSURE

Systems and methods for stimulating a plurality of zones of a subterranean formation to increase production of reservoir fluids therefrom. The subterranean formation contains a well that includes a liner, which defines a liner conduit. The systems and methods include stimulating the plurality of zones with a stimulation assembly that is present within the liner conduit without requiring removal of the stimulation assembly from the liner conduit. The stimulation assembly includes a perforation device and a resettable sealing device that are coupled together for movement uphole and downhole within the liner, and thus within the liner conduit defined thereby. The perforation device is configured to selectively form perforations in a plurality of portions of the liner. The resettable sealing device is configured to fluidly isolate the plurality of portions of the liner from a respective plurality of downhole portions of the liner. The fluid isolation provides for selective introduction of a stimulant fluid to a selected zone of the subterranean formation that is associated with a corresponding portion of the liner.

In some embodiments, the systems and methods may include perforating a first portion of the liner, isolating the first portion of the liner from fluid communication with a first downhole portion of the liner, and/or introducing the stimulant fluid from a surface region, through the first perforation, and into a first zone of the subterranean formation that is associated with the first portion of the liner to stimulate the first zone of the subterranean formation. Such embodiments optionally may further include locating or otherwise positioning the stimulation assembly within the first portion of the liner, such as before perforating the first portion of the liner. In some embodiments, the systems and methods also may include perforating a second portion of the liner, isolating the second portion of the liner from fluid communication with a second downhole portion of the liner, and/or introducing the stimulant fluid from the surface region, through the second perforation, and into a second zone of the subterranean formation that is associated with the second portion of the liner to stimulate the second zone of the subterranean formation. Such embodiments optionally may further include locating or otherwise positioning the stimulation assembly within the second portion of the liner, such as before perforating the second portion of the liner.

In some embodiments, the systems and methods further may include stimulating an initial zone, which may be a terminal zone, of the subterranean formation prior to stimulation of the first and/or second zones of the subterranean formation. In some embodiments, the systems and methods may include stimulating at least one subsequent zone, and optionally a plurality of subsequent zones, of the subterranean formation after stimulation of the first and second zones of the subterranean formation. In some embodiments, the systems and methods may include stimulating the initial, first, second, and/or subsequent zones of the subterranean formation without requiring removal of the stimulation assembly from the liner conduit.

In some embodiments, the resettable sealing device is positioned or otherwise located uphole from the perforation device. In some embodiments, the resettable sealing device is positioned or otherwise located downhole from the perforation device. In some embodiments, the stimulation assembly includes a plurality of resettable sealing devices. In some embodiments, the stimulation assembly includes a motive device. In some embodiments, the stimulation assembly includes and/or is separably attached to a wiper plug. In some embodiments, a controller controls the operation of the stimulation assembly.

DETAILED DESCRIPTION AND BEST MODE OF THE DISCLOSURE

Figure 1:
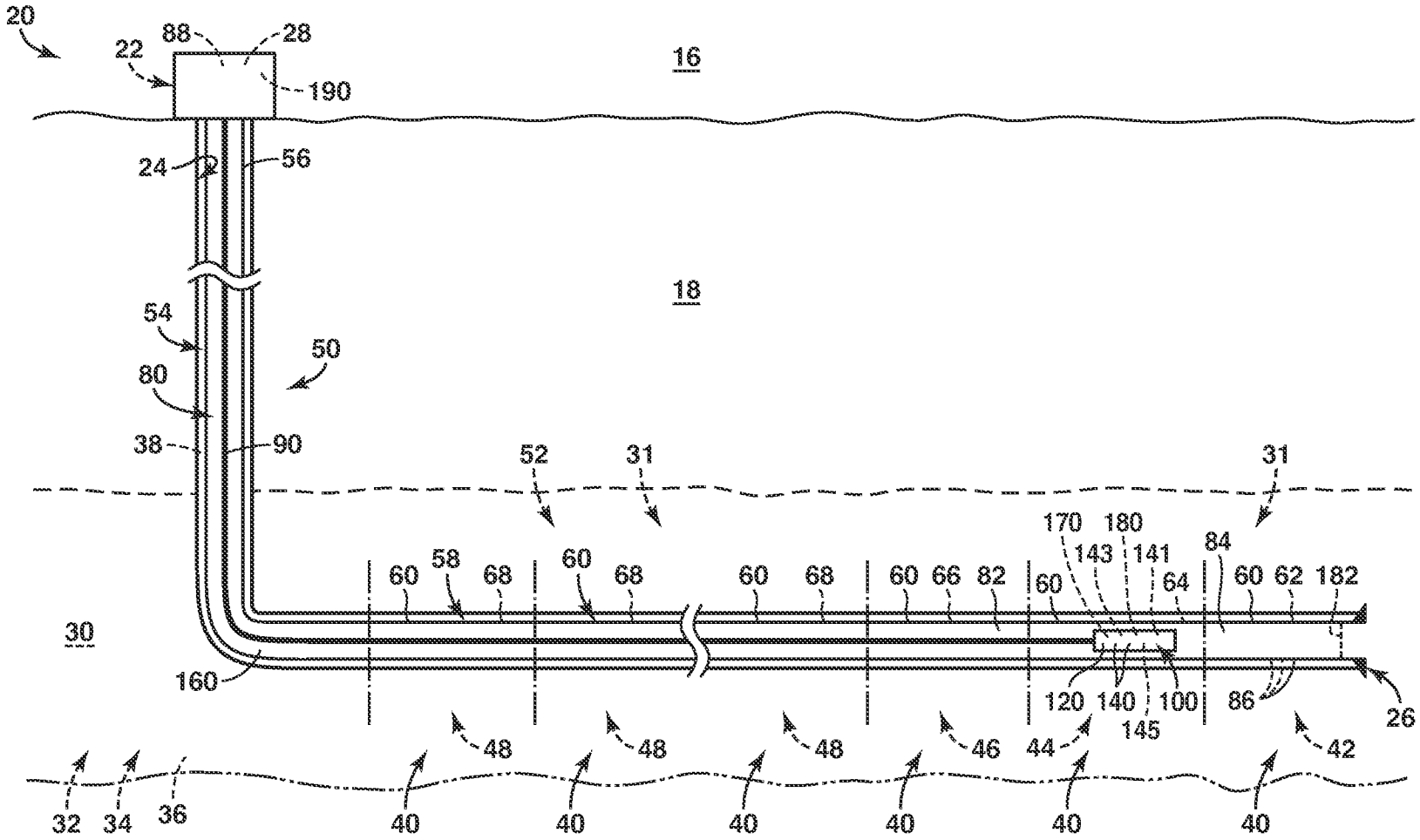
FIG. 1 is a schematic representation of illustrative, non-exclusive examples of a well that may include and/or be utilized with the systems and methods according to the present disclosure.

FIG. 1 is a schematic representation of illustrative, non-exclusive examples of a well 20 that may include and/or be utilized with the systems and methods according to the present disclosure. Well 20 includes a wellbore 24 that contains, includes, and/or surrounds casing, or casing string, 54. Casing 54 includes at least a first casing section 56 and a liner 58, and at least a portion of which may be held, located, and/or affixed within the wellbore with cement 38 and/or another suitable securing agent. Liner 58 defines a liner conduit 80. By this it is meant that the liner surrounds and/or otherwise bounds a fluid passage, or fluid opening, through which fluids may flow uphole and downhole within the liner.

As used herein, "casing" refers to any form of protective lining for wellbore 24 (such as linings known to persons skilled in the art as a "casing," "casing string," "liner," "tubular," etc.), made of any material or combination of materials (such as metals, polymers or composites, etc.), installed in any manner (such as by cementing in place, expanding, etc.) and whether continuous or segmented, jointed or unjointed, threaded or otherwise joined, etc. In the context of the systems and methods of the present disclosure, the term "liner" will be used to denote the region(s) of the casing that are perforated and selectively sealed with the subsequently described stimulation assembly. However, and as indicated above and as should be known to persons of skill in the art, it is within the scope of the present disclosure for the liner, liner conduit, liner portion, etc. that are referred to herein to additionally or alternatively be referred to as a casing, casing conduit, casing portion, etc.

The wellbore extends between a surface region 16 and a subsurface region 18, which may contain, include, and/or be a subterranean formation 30. Well 20 also may include a casing shoe 26, which may be utilized during formation of well 20, and/or a landing collar 182, which may be utilized with, and/or form a portion of, the systems and methods that are discussed in more detail herein with reference to FIGS. 21-23.

In the illustrative, non-exclusive example of FIG. 1, well 20 includes an at least substantially vertical portion, region, and/or section 50, as well as an at least substantially horizontal portion, region, and/or section 52. As illustrated, horizontal portion 52 extends within subterranean formation 30, which also may be referred to herein as a pay zone 30. Illustrative, non-exclusive examples of subterranean formations 30 that may be utilized with the systems and methods according to the present disclosure include an oil shale formation 32 and/or a carbonate formation 34. Subterranean formation 30 may include one or more pay zones 31 that may include a hydrocarbon 36, such as shale oil, petroleum, and/or kerogen and it may be desirable to produce the hydrocarbon therefrom.

Well 20 and/or wellbore 24, casing string 54, casing section 56, liner 58, and/or liner conduit 80 thereof may include any suitable length, which also may be referred to herein as an overall length. As illustrative, non-exclusive examples, the length of the well may be at least 5 kilometers (km), at least 7.5 km, at least 10 km, at least 12.5 km, at least 15 km, at least 20 km, or at least 25 km. In addition, horizontal portion 52 may include any suitable fraction of the length of well 20. As illustrative, non-exclusive examples, the horizontal portion may include at least 10%, at least 25%, at least 50%, at least 60%, at least 70%, at least 75%, at least 80%, or at least 90% of the length of the well. Alternatively, it is also within the scope of the present disclosure that well 20 may not include horizontal portion 52.

As shown in dash-dot lines in FIG. 1, it may be desirable to stimulate a plurality of regions 40 of subterranean formation 30. This may include providing the stimulant fluid to the one or more pay zones 31 that are contained within the subterranean formation to initiate and/or increase a production rate of hydrocarbons 36 therefrom. In the illustrative, non-exclusive example of FIG. 1, the plurality of regions includes an initial region 42, a first region 44, a second region 46, and/or a plurality of subsequent regions 48.

Stimulating the plurality of regions 40 of the subterranean formation may include the use of a stimulation assembly 100 to create a plurality of perforations 86 within a plurality of portions 60 of liner 58 and/or to direct a stimulant fluid 160 through one or more selected perforation(s) of the plurality of perforations. As an illustrative, non-exclusive example, and as discussed in more detail herein, the stimulating may include creating an initial perforation in an initial portion 62 of the liner and providing the stimulant fluid through the initial perforation and to initial region 42 of the subterranean formation. The stimulating also may include creating a first perforation in a first portion 64 of liner 58 and providing the stimulant fluid through the first perforation and to first region 44 of the subterranean formation.

Subsequently, the stimulating may include creating a second, or subsequent, perforation in a second 66, or subsequent 68, portion of liner 58 and providing the stimulant fluid through the second, or subsequent, perforation and to the second 46, or subsequent 48, region of the subterranean formation. Thus, a given portion 60 of liner 58 may be perforated and receive stimulant fluid 160 in order to stimulate a selected, complementary, and/or corresponding region 40 of subterranean formation 30.

It is within the scope of the present disclosure that liner 58 may include any suitable number of portions 60. As illustrative, non-exclusive examples, the liner may include at least 5, at least 10, at least 15, at least 20, at least 25, at least 30, at least 35, at least 40, at least 45, at least 50, at least 55, at least 60, at least 65, or at least 70 portions. Moreover, and as discussed herein, the systems and methods of the present disclosure may selectively stimulate a plurality of the regions 40, including at least 2, at least 5, at least 10, etc., through a corresponding plurality of portions 60, without requiring removal of the subsequently discussed stimulation assembly from the wellbore, or liner thereof.

It is also within the scope of the present disclosure that the plurality of portions 60 of liner 58 may include any suitable length, which also may be referred to herein as a longitudinal length and/or a length along a longitudinal axis of liner 58. As illustrative, non-exclusive examples, at least a subset of the plurality of portions 60 of liner 58 may include a length of at least 1 meter (m), at least 3 m, at least 5 m, at least 10 m, at least 20 m, at least 30 m, at least 40 m, at least 50 m, at least 60 m, at least 70 m, at least 80 m, at least 90 m, or at least 100 m, and/or a length of less than 300 m, less than 250 m, less than 150 m, less than 125 m, less than 100 m, less than 90 m, less than 80 m, less than 70 m, or less than 60 m. Illustrative, non-exclusive examples of the subset of the plurality of portions of the liner include a majority, at least 60%, at least 70%, at least 80%, at least 90%, at least 95%, at least 99%, or all of the plurality of portions of the liner.

It is within the scope of the present disclosure that each of the plurality of portions 60 may include a similar, or at least substantially similar, length. However, it is also within the scope of the present disclosure that a longitudinal length of a selected portion 60 of liner 58 may be different from a longitudinal length of another portion of the liner. It is further within the scope of the present disclosure that an overall, cumulative, and/or total length of the plurality of portions 60 that include perforations 86 may be at least 1,000 m, at least 1,250 m, at least 1,500 m, at least 1,750 m, at least 2,000 m, at least 2,250 m, at least 2,500 m, at least 2,750 m, at least 3,000 m, at least 3,250 m, at least 3,500 m, at least 3,750 m, at least 4,000 m, at least 4,250 m, at least 4,500 m, at least 4,750 m, or at least 5,000 m.

Well 20 and/or stimulation assembly 100 may include and/or be in electrical, mechanical, and/or fluid communication with any suitable structure that may be utilized to control the operation of well 20, control the operation of stimulation assembly 100, and/or control a flow of stimulant fluid 160. As illustrative, non-exclusive examples, well 20 may include a wellhead 22 that is configured to control a supply of fluid and/or equipment into liner conduit 80 and/or a removal of fluid and/or equipment from the liner conduit. As another illustrative, non-exclusive example, wellhead 22 may include a pump 28 that is configured to provide stimulant fluid 160 to liner conduit 80. As yet another illustrative, non-exclusive example, well 20 and/or stimulation assembly 100 may include and/or be in communication with a controller 190 that is configured to control the operation of well 20 and/or stimulation assembly 100.

Stimulation assembly 100 may include any suitable structure that is configured to form perforations 86 in liner 58, such as in portions 60 thereof, and to direct stimulant fluid 160 therethrough. It is within the scope of the present disclosure that, as discussed in more detail herein with reference to FIGS. 2-23, stimulation assembly 100 may be configured to form at least one perforation in the plurality of portions 60 of liner 58 and to selectively direct stimulant fluid 160 through one or more selected perforation(s) in each of the plurality of portions of the liner without removal of the stimulation assembly from within the liner, such as from liner conduit 80. Although not required to all embodiments, the stimulation assembly may be mechanically connected and/or in electrical communication with surface region 16 and/or wellhead 22 via a wireline 90. When wireline 90 provides a mechanical connection with the surface region but not a pathway for electrical communication with the surface region, the wireline may additionally or alternatively be referred to as a slick line.

The stimulation assembly may include and/or be in communication with a controller 190 that is programmed or otherwise configured to control the operation of the stimulation assembly. Additionally or alternatively, the operation of stimulation assembly 100 also may be controlled by wireline 90, which as discussed may form a mechanical connection with and/or is in electrical communication with the stimulation assembly and which may be configured to provide the mechanical connection and/or the electrical communication between stimulation assembly 100 and surface region 16, wellhead 22, and/or controller 190.

As an illustrative, non-exclusive example, stimulation assembly 100 may include a perforation device 120 that is configured to form the one or more perforations 86 within the plurality of portions 60 of the liner. As another illustrative, non-exclusive example, stimulation assembly 100 (also) may include a resettable sealing device 140 that is configured to fluidly isolate an uphole portion 82 of liner 58 and/or liner conduit 80 thereof from a downhole portion 84 of the liner and/or the liner conduit. By "fluidly isolate," it is meant that the resettable sealing device obstructs, limits, and/or prevents fluids, such as wellbore fluids, from flowing past the resettable sealing device from one portion of the liner, or liner conduit defined thereby, to another portion of the liner, or liner conduit defined thereby. Thus, fluid isolation by the resettable sealing device of one portion 60 of the liner from another portion of the liner additionally or alternatively may be referred to herein as fluid isolation of one portion of the fluid conduit from another portion of the fluid conduit, with the corresponding portions of the fluid conduit being defined by the respective portions 60 of liner 58 through which the portions of the fluid conduit extent. Subsequent to isolation of uphole portion 82 from downhole portion 84, stimulant fluid 160 may be provided to the liner conduit and may be directed to one or more perforations that are uphole from stimulation assembly 100 and/or uphole from resettable sealing device 140 thereof.

Thus, a stimulation assembly 100 according to the present disclosure may include a perforation device 120 and at least one resettable sealing device 140, with the perforation device and the at least one resettable sealing device being coupled together for movement (together) uphole and/or downhole within the liner, and thus within the liner conduit defined thereby. Additionally or alternatively, the perforation device and at least one resettable sealing device may be described as being secured together, affixed together, linked together, attached together, coupled for movement as a unit, secured together for integrated movement, joined together, etc. This coupling of the components of the stimulation assembly may include direct mechanical or other contact, but also may include intermediate structures and/or rigid or flexible linkages between the respective components so long as these components (perforation device and at least one resettable sealing device) are configured to move uphole and/or downhole together, as a unit, and/or by the same motive force or propulsion mechanism. It is within the scope of the present disclosure that this coupling may include a rigid, or at least substantially rigid, coupling that does not provide for a change, or at least a significant change, in a distance between the perforation device and the at least one resettable sealing device. However, it is also within the scope of the present disclosure that this coupling may include a flexible coupling that does provide for a change in the distance between the perforation device and the at least one resettable sealing device but that maintains a relative orientation therebetween and a relative proximity between these components.

It is within the scope of the present disclosure that resettable sealing device 140 may include any suitable relative orientation with respect to the perforation device. As an illustrative, non-exclusive example, and as discussed in more detail herein with reference to FIGS. 3-13, the resettable sealing device may be positioned or otherwise located uphole from the perforation device. As another illustrative, non-exclusive example, and as discussed in more detail herein with reference to FIGS. 14-23, the resettable sealing device may be positioned or otherwise located downhole from the perforation device. As yet another illustrative, non-exclusive example, it is also within the scope of the present disclosure that the resettable sealing device may be at least partially coextensive with the perforation device within liner conduit 80.

As used herein, the terms "uphole" and "downhole" are relative measures of a location within well 20, such as within wellbore 24, liner 58, and/or liner conduit 80 thereof, when compared to another location and/or structure. As an illustrative, non-exclusive example, when a first structure is uphole from a second structure, a distance between the first structure and surface region 16 and/or wellhead 22, as measured along a length of wellbore 24, may be shorter than a distance between the second structure and surface region 16 and/or wellhead 22. Additionally or alternatively, the second structure may be described as being downhole from the first structure when the distance between the second structure and the surface region, as measured along the length of wellbore 24, is greater than the distance between the first structure and the surface region. As illustrative, non-exclusive examples, and as shown in FIG. 1, initial portion 62 may be described as being downhole from stimulation assembly 100, stimulation assembly 100 may be described as being uphole from initial portion 62, second portion 66 may be described as being uphole from stimulation assembly 100, stimulation assembly 100 may be described as being downhole from second portion 66, second portion 66 may be described as being uphole from initial portion 62, and/or initial portion 62 may be described as being downhole from second portion 66.

Stimulation assembly 100 may include and/or be in mechanical communication with and/or coupled to one or more additional structures. As an illustrative, non-exclusive example, and as discussed in more detail herein with reference to FIGS. 3-7, the stimulation assembly also may include a motive device 170 that is configured to convey the stimulation assembly along a length of the liner, and thus along a length of the liner conduit defined thereby. Illustrative, non-exclusive examples of motive devices 170 according to the present disclosure include any suitable mechanical motive device, electrically powered motive device, motorized motive device, and/or tractor that is coupled to, and/or forms a portion of, the stimulation assembly. The motive devices may be configured to receive an electric current from wireline 90 and to produce a motive force therefrom.

As another illustrative, non-exclusive example, and as discussed in more detail herein with reference to FIGS. 8-13, the stimulation assembly may include a plurality of resettable sealing devices. As yet another illustrative, non-exclusive example, and as discussed in more detail herein with reference to FIGS. 21-23, the stimulation assembly may include, be separably attached to, be used in conjunction with, and/or be in at least temporary mechanical communication with a wiper plug 180 and/or landing collar 182.

Stimulant fluid 160 may include any suitable fluid that may be provided to subterranean formation 30 to stimulate or otherwise promote the production of hydrocarbons 36 therefrom. As an illustrative, non-exclusive example, the stimulant fluid may include a fracturing fluid that is configured to create one or more fractures within the subterranean formation. As another illustrative, non-exclusive example, the stimulant fluid may include a proppant that is configured to maintain the one or more fractures in an open configuration when a pressure of the stimulant fluid within subterranean formation 30 and/or region 40 thereof is decreased. As yet another illustrative, non-exclusive example, the stimulant fluid may include an acid that is configured to dissolve at least a portion the subterranean formation. Illustrative, non-exclusive examples of stimulant fluids that may be utilized with the systems and methods according to the present disclosure include water, a proppant, and/or an acid solution.

Perforation device 120 may include any suitable structure that is configured to create the one or more perforations 86 in each of the selected plurality of portions 60 of liner 58 without being removed from liner conduit 80. As an illustrative, non-exclusive example, the perforation device may include and/or be a perforating gun that includes a plurality of perforation charges.

The operation of the perforation device within liner conduit 80 may be controlled in any suitable manner. As an illustrative, non-exclusive example, wireline 90 may be utilized to provide an electric current to the perforation device to control the operation thereof, such as to initiate discharge of a selected one or more of the plurality of perforation charges and to create a selected perforation or plurality of perforations therewith. As another illustrative, non-exclusive example, controller 190 may provide the electric current to the perforation device via wireline 90.

Figure 2:
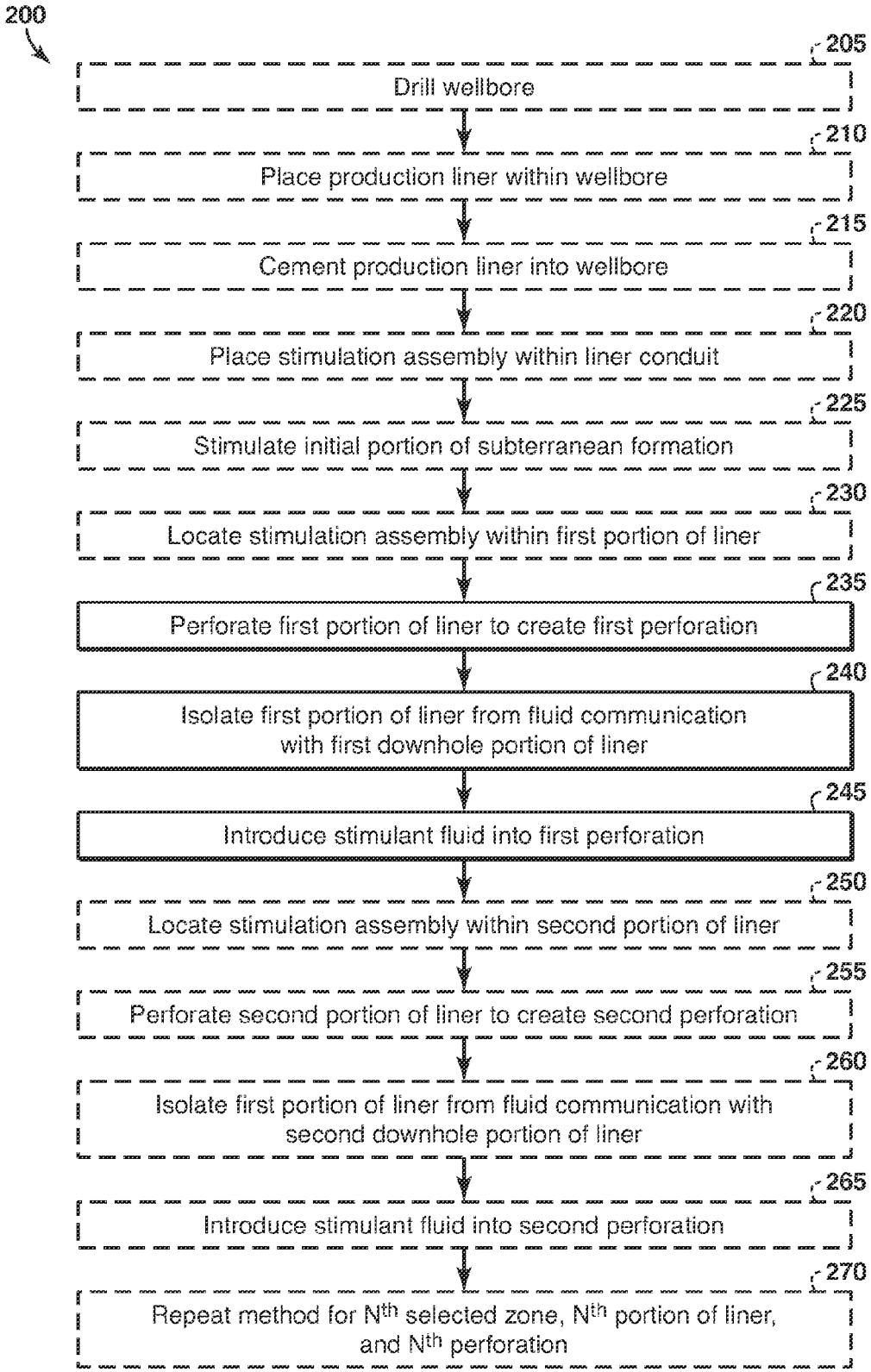
FIG. 2 is a flowchart depicting methods according to the present disclosure of stimulating a plurality of zones of a subterranean formation.
Figure 3:
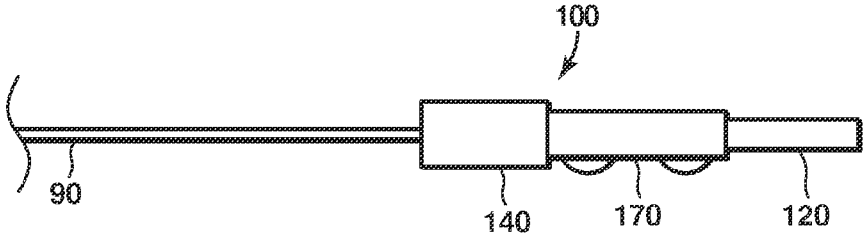
FIGS. 3-7 provide schematic representations of illustrative, non-exclusive examples of a stimulation assembly that includes a motive device and a resettable sealing device that is uphole from a perforation device.

It is within the scope of the present disclosure that, as discussed in more detail herein with reference to FIG. 2, stimulation assembly 100 and/or perforation device 120 thereof may be configured, programmed, operated, and/or controlled to create perforations 86 within any suitable portions 60 of liner 58. Additionally or alternatively, it is also within the scope of the present disclosure that liner 58 may any suitable spacing between perforations 86.

As an illustrative, non-exclusive example, the stimulation assembly may be configured to create perforations 86 in portions 60 of liner 58 that are proximal to and/or within subterranean formation 30 and/or within one or more pay zones 31 thereof. This may include selectively determining a given portion of liner 58 that will include one or more perforations 86 based upon any suitable criteria, illustrative, non-exclusive examples of which are discussed in more detail herein.

It is within the scope of the present disclosure that the stimulation assembly may create one or more perforations 86 in each portion 60 of liner 58. Alternatively, it is also within the scope of the present disclosure that the stimulation assembly may create one or more perforations 86 within selected portions 60 and/or a subset of the portions 60 of liner 58.

Perforation device 120 may be configured to create a plurality of perforations in at least a subset of the plurality of portions of the liner. This may include creating at least 2, at least 3, at least 4, at least 5, at least 6, at least 7, at least 8, at least 10, or at least 12 perforations in each portion 60 of the liner that is included in the subset of the plurality of portions of the liner. Illustrative, non-exclusive examples of the subset of the plurality of portions of the liner include at least 60%, at least 70%, at least 80%, at least 90%, at least 95%, at least 99%, or all of the plurality of portions of the liner. Similarly, it is within the scope of the present disclosure that perforations 86 may include any suitable size and/or shape of aperture, illustrative, non-exclusive examples of which include a hole, a slit, an opening, and/or a void.

Resettable sealing device 140 may include any suitable structure that is configured to fluidly isolate uphole portion 82 from downhole portion 84 of liner 58. Resettable sealing device 140 also is configured to be selectively released, or unset, from such a sealing configuration in which uphole portion 82 is fluidly isolated from downhole portion 84, and thereafter returned to the sealing configuration, typically to fluidly isolate another uphole portion of the liner from another downhole portion of the liner. In other words, the resettable sealing device is configured to be repeatedly configured between a sealing (expanded) configuration and an unsealed (i.e., contracted and/or motive configuration, such as discussed herein), without destruction or damage to the resettable sealing device or surrounding portions of the liner and/or without requiring drilling or other destructive processes to remove the resettable sealing device when it is in a sealed configuration. Illustrative, non-exclusive examples of resettable sealing devices 140 according to the present disclosure include a bridge plug, a through tubing bridge plug, a through tubing inflatable bridge plug, a resettable bridge plug, an inflatable bridge plug, an expandable bridge plug, a selectively expandable and contractible bridge plug, and a sealing device that is configured to be selectively expanded and contracted a plurality of times while it is within the liner conduit.

Resettable sealing devices 140 may include and/or define an internal volume, or cavity, 141 that is configured to contain a fluid therein. Illustrative, non-exclusive examples of fluids include fluid that is drawn from proximate the pump, resettable sealing device(s), and/or stimulation assembly, fluid from within the fluid conduit, a wellbore fluid that is drawn or otherwise obtained from within the wellbore (such as from a location proximate the stimulation assembly, which additionally or alternatively may be referred to as a downhole location relative to the surface region), a reservoir fluid that is drawn or otherwise obtained from the subterranean formation, a stored fluid that is pumped from a storage vessel that is in fluid communication with the resettable sealing device, and/or a surface fluid that is pumped from the surface to the resettable sealing device (and optionally vice versa). Thus, it is within the scope of the present disclosure that the resettable sealing device may be configured to receive a fluid that is not provided directly from the surface region, in contrast to a resettable sealing device that is configured to be expanded via fluid delivered from the surface region via coiled (or other) tubing. In some embodiments, the resettable sealing device may be configured to discharge the fluid to the wellbore, while in other embodiments, it may be configured to discharge the fluid to the formation, the storage vessel, and/or the surface.

In embodiments that include a resettable sealing device 140 that defines such an internal volume, or cavity, 141, receipt of the fluid into internal volume 141 may expand the resettable sealing device and/or increase internal volume 141 thereof. This expansion may provide and/or increase an obstruction to fluid flow past the resettable sealing device when the resettable sealing device is present within liner conduit 80. As another illustrative, non-exclusive example, discharge of the fluid from internal volume 141 may contract the resettable sealing device and/or decrease internal volume 141 thereof. This contraction may decrease the obstruction to fluid flow past the resettable sealing device and/or provide for fluid flow therepast when the resettable sealing device is present within liner conduit 80.

It is also within the scope of the present disclosure, but not required to all embodiments, that stimulation assembly 100 and/or resettable sealing device 140 thereof may include and/or be in fluid communication with a pump 143 that is configured to convey the fluid between an interior of the resettable sealing device and an exterior of the resettable sealing device to selectively expand and/or contract the resettable sealing device. Accordingly, pump 143, when present, may be configured to draw fluid from the liner conduit into the resettable sealing device, such as to expand the resettable sealing device toward and/or to a sealing configuration, and/or to withdraw fluid from the resettable sealing device, such as to contract the resettable sealing device toward and/or to a contracted configuration. The withdrawn fluid may be delivered to the liner conduit, the wellbore, and/or the formation. As an illustrative, non-exclusive example, the pump may be configured to expand the resettable sealing device by increasing a volume of fluid that is within internal volume 141. As another illustrative, non-exclusive example, the pump may be configured to contract the resettable sealing device by decreasing the volume of fluid that is within internal volume 141.

It is within the scope of the present disclosure that the operation of pump 143, and thus the expansion and/or contraction of the resettable sealing device, may be controlled in any suitable manner. As an illustrative, non-exclusive example, wireline 90 may be configured to provide an electric current to the pump to control the operation thereof, such as to initiate supply of fluid to the interior of the resettable sealing device and/or removal of fluid from the interior of the resettable sealing device. As another illustrative, non-exclusive example, controller 190 may be configured to provide the electric current to the resettable sealing device via wireline 90.

Resettable sealing device 140 also may include and/or be a compliant material 145 that is configured to expand, contract, and/or deform responsive to one or more forces that may be applied thereto. As an illustrative, non-exclusive example, compliant material 145 may define and/or bound internal volume 141.

As another illustrative, non-exclusive example, the resettable sealing device may be configured to mechanically compress compliant material 145 in a first dimension, such as a dimension that is parallel to a longitudinal axis of liner conduit 80, and the compliant material may be configured to expand in a second dimension, such as a dimension that is parallel to a radial axis of liner conduit 80. This expansion may increase an obstruction to fluid flow past the resettable sealing device when the resettable sealing device is present within liner conduit 80.

As another illustrative, non-exclusive example, the resettable sealing device may be configured to mechanically extend compliant material 145 in the first dimension, and the compliant material may be configured to contract in the second dimension. This may decrease an obstruction to fluid flow past the resettable sealing device when the resettable sealing device is present within liner conduit 80.

Wireline 90 may include any suitable structure that is configured to provide mechanical and/or electrical communication and/or connection with stimulation assembly 100 and/or between surface region 16, wellhead 22, and/or controller 190 and the stimulation assembly. As illustrative, non-exclusive examples, wireline 90 may include any suitable cable, flexible mechanical linkage, wire, insulated wire, and/or electrical conduit. It is within the scope of the present disclosure that, as discussed herein, the wireline may be configured to provide an electric current to stimulation assembly 100, such as to perforation device 120, resettable sealing device 140, and/or motive device 170 thereof, to control the operation of the stimulation assembly.

It is also within the scope of the present disclosure that wireline 90 may be configured to provide a motive force to the stimulation assembly while the stimulation assembly is within liner conduit 80. As an illustrative, non-exclusive example, a wireline spool 88 may be configured to apply a tensile force to the wireline. Application of the tensile force to the wireline may provide a motive force to move stimulation assembly 100 in an uphole direction.

Controller 190 may include any suitable structure that is adapted, configured, and/or programmed to control at least a portion of well 20, wireline spool 88, stimulation assembly 100, perforation device 120, motive device 170, and/or resettable sealing device 140. As an illustrative, non-exclusive example, the controller may be configured to perform the methods that are discussed in more detail herein with reference to FIG. 2 and/or control the processes that are discussed in more detail herein with reference to FIGS. 3-23. As another illustrative, non-exclusive example, controller 190 may be configured to provide a perforation signal to perforation device 120 while the perforation device is in each of the plurality of portions of the liner, and the perforation device may be configured to form the one or more perforations in each of the plurality of portions of the liner responsive, at least in part, to receipt of the perforation signal.

As another illustrative, non-exclusive example, the controller may be configured to provide an isolation signal to the resettable sealing device while the resettable sealing device is within each of the plurality of portions of the liner, and the resettable sealing device may be configured to isolate a respective downhole portion of the liner from a respective uphole portion of the liner responsive, at least in part, to receipt of the isolation signal. It is within the scope of the present disclosure that the controller may be configured to selectively, systematically, and/or repeatedly form the one or more perforations in each of the plurality of portions of the liner and to selectively isolate the respective downhole portion of the liner from the respective uphole portion of the liner in each of the plurality of portions of the liner without removal of stimulation assembly 100 from liner conduit 80. As illustrative, non-exclusive examples, this may include selectively perforating and isolating at least 3, at least 5, at least 10, at least 15, at least 20, at least 25, at least 30, at least 35, at least 40, at least 45, at least 50, at least 55, at least 60, at least 65, or at least 70 portions of the liner without removal of the stimulation assembly from the liner conduit.

FIG. 2 is a flowchart depicting methods 200 according to the present disclosure of stimulating a plurality of zones of a subterranean formation. Methods 200 may, but are not required to, include drilling a wellbore at 205, placing a production liner within the wellbore at 210, cementing the production liner into the wellbore at 215, placing a stimulation assembly within a liner conduit at 220, and/or stimulating an initial portion of the subterranean formation at 225. The methods include perforating a first portion of the liner to create a first perforation at 235, isolating the first portion of the liner from fluid communication with a first downhole portion of the liner at 240, and introducing a stimulant fluid into the first perforation at 245. The methods optionally may include, before perforating the first portion of the liner at 235, locating (or otherwise positioning) the stimulation assembly within a first portion of the liner, as indicated at 230. The methods may further include perforating a second portion of the liner to create a second perforation at 255, isolating the second portion of the liner from fluid communication with a second downhole portion of the liner at 260, and introducing the stimulant fluid into the second perforation at 265. As indicated at 250, the methods optionally may further include locating (or otherwise positioning) the stimulant assembly within the second portion of the liner. The methods further may include repeating the method for an Nth selected zone, Nth portion of the liner, and/or Nth perforation at 270.

Drilling the wellbore at 205 may include the use of any suitable system and/or method to drill the wellbore. As an illustrative, non-exclusive example, the drilling may include drilling with a drill rig that may include a downhole assembly, a drill bit, and/or a drill string. Placing the production liner within the wellbore at 210 and/or cementing the production liner within the wellbore at 215 may include the use of any suitable system and/or method to place and/or retain the production liner within the wellbore. Similarly, placing the stimulation assembly, such as any of the stimulation assemblies 100 disclosed herein, within the liner conduit at 220 may include the use of any suitable system and/or method to move the stimulation assembly from a surface region and into the well and/or the liner conduit thereof.

Stimulating the initial portion of the subterranean formation at 225 may include locating or otherwise positioning the stimulation assembly within the initial portion of the liner and/or liner conduit, perforating the initial portion of the liner with the perforation device (such as any of the perforation devices 120 disclosed herein) to create an initial perforation, isolating the initial portion of the liner from fluid communication with an initial downhole portion of the liner, and/or introducing the stimulant fluid from the surface region into the liner conduit and through the initial perforation. The locating, perforating, isolating, and/or introducing may be substantially similar to the locating, perforating, isolating, and/or introducing steps that are discussed in more detail herein with reference to the first and/or second portion(s) of the liner. However, it is within the scope of the present disclosure that, when the wellbore only includes the initial perforation, stimulating the initial portion of the subterranean formation may include performing the locating, perforating, and introducing steps without isolating the initial portion of the wellbore from the initial downhole portion of the wellbore.

Locating the stimulation assembly within the first portion of the liner at 230 and/or locating the stimulation assembly within the second portion of the liner at 250 may include the use of any suitable system and/or method to locate, place, and/or otherwise situate the stimulation assembly within a desired portion of, or location within, the liner (i.e., within the region of the liner conduit defined thereby). As an illustrative, non-exclusive example, the locating may include moving the stimulation assembly along the liner conduit by gravitational force. As another illustrative, non-exclusive example, and as discussed in more detail herein, the locating may include expanding the resettable sealing device to a motive configuration and conveying the stimulation assembly in a downhole direction by supplying a motive fluid to the liner conduit, with the motive fluid conveying the stimulation assembly in a downhole direction as the motive fluid engages and flows past the resettable sealing device. As another illustrative, non-exclusive example, and as also discussed in more detail herein, the locating may include contracting the resettable sealing device to a contracted configuration and pulling the stimulation assembly in an uphole direction with the wireline. As yet another illustrative, non-exclusive example, the locating may include moving the stimulation assembly with a motive device.

Figure 9:
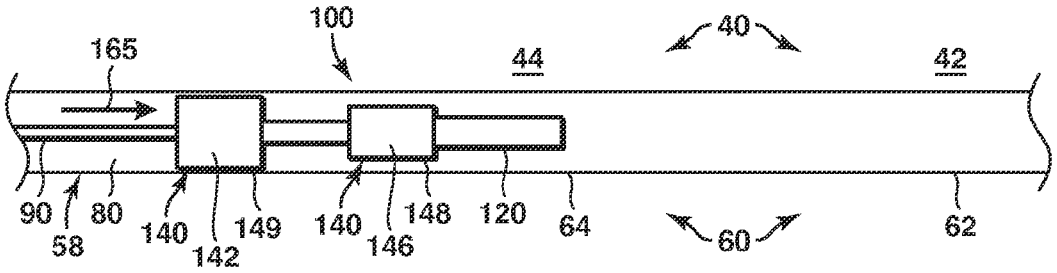
Figure 12:
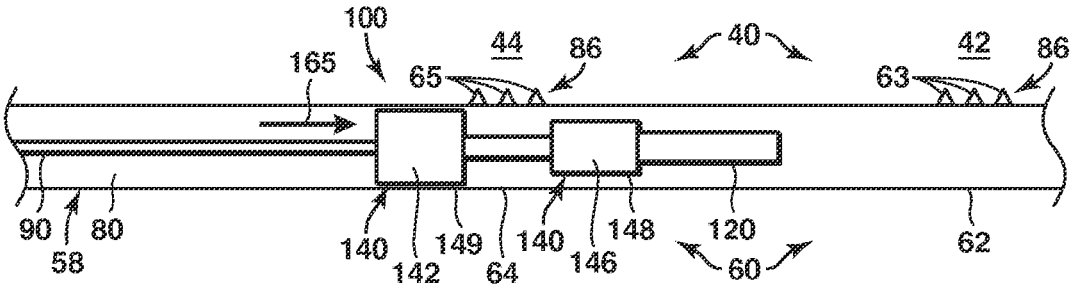
Figure 15:
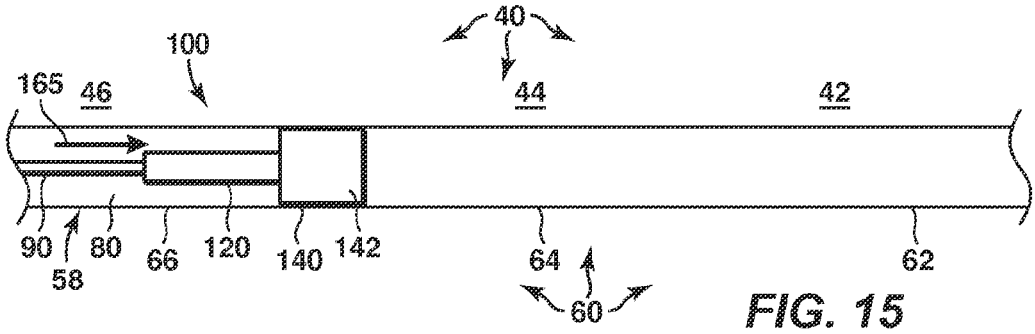

It is within the scope of the present disclosure that, as discussed in more detail herein with reference to FIGS. 9, 12, and 15, the motive configuration may include a configuration in which an outer diameter of the resettable sealing device is within a maximum threshold fraction of an outer diameter of the liner conduit, which also may be referred to herein as an inner diameter of the liner. Illustrative, non-exclusive examples of maximum threshold fractions according to the present disclosure include maximum threshold fractions of at least 50%, at least 60%, at least 70%, at least 75%, at least 80%, at least 85%, at least 90%, at least 95%, or at least 99% of the diameter of the liner conduit, and/or maximum threshold fractions of less than 99%, less than 97.5%, less than 95%, less than 92.5%, or less than 90% of the diameter of the liner conduit.

Similarly, it is also within the scope of the present disclosure that the contracted configuration may include a configuration in which the outer diameter of the resettable sealing device is within a minimum threshold fraction of an outer diameter of the liner conduit. Illustrative, non-exclusive examples of minimum threshold fractions according to the present disclosure include minimum threshold fractions of less than 75%, less than 70%, less than 60%, less than 50%, less than 40%, or less than 30% of the diameter of the liner conduit.

The locating may include selecting a distance between a given portion of the liner and a subsequent portion of the liner based upon any suitable criteria. As an illustrative, non-exclusive example, the selecting may include selecting a predetermined distance between the given portion of the liner and the subsequent portion of the liner. As another illustrative, non-exclusive example, the selecting may include determining the distance based, at least in part, on one or more variables associated with the well that may be determined before drilling the well, while drilling the well, while providing the stimulant fluid, and/or after providing the stimulant fluid.

As an illustrative, non-exclusive example, a distance between the initial portion and the first portion may be determined based, at least in part, on one or more variables associated with the well that are measured during stimulation of the initial region of the subterranean formation. As another illustrative, non-exclusive example, a distance between the first portion and the second portion may be determined based, at least in part, on one or more variables associated with the well that are measured during stimulation of the initial region and/or the first region of the subterranean formation. As yet another illustrative, non-exclusive example, a distance between a given portion and a subsequent portion may be determined based, at least in part, on one or more variables associated with the well that are measured during stimulation of any previous region and/or regions of the subterranean formation.

Illustrative, non-exclusive examples of variables associated with the well include a length of the liner conduit, a diameter of the liner conduit, a flow rate of the stimulant fluid during the introducing step, a supply pressure of the stimulant fluid during the introducing step, a diameter of the perforation that is associated with the given portion of the liner, a nature of the subterranean formation, a chemical composition of the stimulant fluid, a duration of one or more prior stimulations of the subterranean formation, a result of one or more prior stimulations of the subterranean formation, a hydrocarbon production obtained from one or more prior stimulations of the subterranean formation, a chemical composition of the hydrocarbon that is contained within the subterranean formation.

Perforating the first portion of the liner at 235 and/or perforating the second portion of the liner at 255 may include the use of any suitable perforation device, such as any of the perforation devices 120 disclosed herein, to form one or more perforations within a selected portion of the liner. As an illustrative, non-exclusive example, and when the perforation device includes a perforation gun that includes a plurality of perforation charges, the perforating may include discharging at least one of the perforation charges to create at least one perforation in the selected portion of the liner.

Isolating the first portion of the liner from fluid communication with the first downhole portion of the liner at 240 and/or isolating the second portion of the liner from fluid communication with the second downhole portion of the liner at 260 may include fluidly isolating a given portion of the liner from a portion of the liner that is downhole from the given portion of the liner using the resettable sealing device, such as any of the resettable sealing devices 140 disclosed herein. As an illustrative, non-exclusive example, the isolating may include expanding the resettable sealing device to a sealing configuration. As discussed, the expanding may include inflating the resettable sealing device, such as by pumping a fluid into the resettable sealing device to increase an internal volume thereof. As an illustrative, non-exclusive example, the expanding may include increasing the outer diameter of the resettable sealing device and/or contacting an inner circumference of the liner conduit with an outer circumference of the resettable sealing device.

As yet another illustrative, non-exclusive example, the isolating may include resisting a flow of fluid past the resettable sealing device. This may include blocking at least 75%, at least 80%, at least 85%, at least 90%, at least 95%, at least 97.5%, at least 99%, at least 99.9%, substantially all, and/or all of a cross-sectional area of the liner with the resettable sealing device.

Additionally or alternatively, the isolating may include resisting the flow of fluid and/or resisting a relative motion between the liner and the resettable sealing device as long as a pressure differential across the resettable sealing device is less than a threshold pressure differential. Illustrative, non-exclusive examples of threshold pressure differentials according to the present disclosure include threshold pressure differentials of at least 10 megapascals (MPa), at least 15 MPa, at least 20 MPa, at least 25 MPa, at least 30 MPa, at least 35 MPa, at least 40 MPa, at least 45 MPa, or at least 50 MPa.

Introducing the stimulant fluid from the surface region through the first perforation at 245 and/or introducing the stimulant fluid from the surface region through the second perforation at 265 may include the use of any suitable system and/or method to provide the stimulant fluid from the surface region, through the liner conduit, and to one or more selected perforations. As illustrative, non-exclusive examples, the introducing may include supplying the stimulant fluid to an end of the liner conduit that is present within a surface region, pumping the stimulant fluid into the liner conduit, and/or bullheading the stimulant fluid into the liner conduit. The introducing thus may include delivering the stimulating fluid directly into the liner conduit from, or proximate, the surface region, as opposed to a coiled tubing assembly in which a stimulating fluid is delivered downhole via a separate (isolated) fluid conduit within the liner. Accordingly, the stimulating assembly may be described as being, and/or being configured to, receive stimulating fluid directly from the liner conduit, as opposed to receiving the stimulating fluid from a separate dedicated conduit, such as is used when the stimulating fluid is delivered with a coiled tubing assembly. Moreover, the stimulating fluid additionally or alternatively may be described as flowing within the liner conduit, in contact with the liner, from, or proximate, the surface region, to the stimulating assembly, whereby the resettable sealing device directs the stimulating fluid to flow through the perforation(s) into the subterranean formation (due to the resettable sealing device preventing the stimulating fluid from flowing further downhole past the resettable sealing device while the resettable sealing device is in a sealing configuration.

It is within the scope of the present disclosure that the introducing also may include providing a fracturing fluid to the subterranean formation and fracturing a region of the subterranean formation that is proximal to the one or more selected perforations through which the stimulant fluid flows. As an illustrative, non-exclusive example, the introducing may include increasing a local pressure within the region of the subterranean formation and generating a fracturing force that may create one or more fractures within the region of the subterranean formation.

Additionally or alternatively, it is also within the scope of the present disclosure that the introducing may include acid treating the region of the subterranean formation that is proximal to the one or more selected perforations. As an illustrative, non-exclusive example, the introducing may include providing an acid solution to the portion of the subterranean formation and dissolving a fraction of the portion of the subterranean formation.

Repeating the method at 270 may include repeating any suitable step and/or steps of the method to locate the stimulation assembly within a subsequent, or Nth, portion of the liner, perforate the subsequent, or Nth, portion of the liner to create a subsequent, or Nth, perforation in the subsequent, or Nth, portion of the liner, and/or introduce the stimulant fluid through the one or more subsequent, or Nth, perforations in the subsequent, or Nth, portion of the liner and into a region of the subterranean formation that is proximal thereto. It is within the scope of the present disclosure that the methods may be repeated any suitable number of times and/or utilized to create any suitable number of perforations in a plurality of portions of the liner. As illustrative, non-exclusive examples, the plurality of portions 60 of the liner may include at least 10, at least 15, at least 20, at least 25, at least 30, at least 35, at least 40, at least 45, at least 50, at least 55, at least 60, at least 65, or at least 70 portions of the liner. Additionally or alternatively, it is also within the scope of the present disclosure that the repeating may include repeating the method without removing the stimulation assembly from the liner conduit.

FIG. 2 and the discussion thereof generally describe methods according to the present disclosure that may be utilized to stimulate a plurality of regions of a subterranean formation without requiring removal of a stimulation assembly from a well, or liner conduit thereof, that is present within the subterranean formation. Similarly, FIGS. 3-23 provide more specific but still illustrative, non-exclusive examples of process flows that may be utilized to stimulate the plurality of regions of the subterranean formation without requiring removal of the stimulation assembly therefrom. These process flows may, additionally or alternatively, be considered to describe illustrative, non-exclusive examples of systems that may be utilized to perform methods that are described by the process flows. It is within the scope of the present disclosure that any of the methods disclosed herein may be utilized within any of the systems of FIG. 1 and/or any of the process flows of FIGS. 3-23 may be utilized with other methods without departing from the scope of the present disclosure.

FIGS. 3-7 provide schematic representations of illustrative, non-exclusive examples of a stimulation assembly 100 according to the present disclosure. Stimulation assembly 100 includes a resettable sealing device 140 that is uphole from a perforation device 120. The stimulation assembly further includes a motive device 170, which as illustrated is positioned or otherwise located between the resettable sealing device and the perforation device. It is within the scope of the present disclosure that the motive device, when present, may be otherwise located relative to the resettable sealing device and/or the perforation device. The stimulation assembly may be in mechanical and/or electrical communication with a surface region, a controller, and/or a remainder of the stimulation assembly via a wireline 90. As shown in FIGS. 4-7, the stimulation assembly may be inserted into a liner 58, or liner conduit 80 thereof, and utilized to form a plurality of perforations 86 within a plurality of portions 60 of the liner and/or to stimulate a plurality of regions 40 of a subterranean formation.

Figure 4:
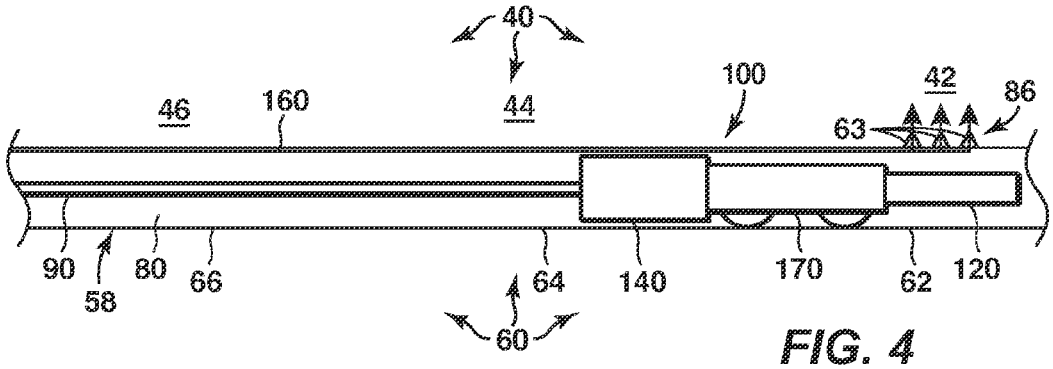

As shown in FIG. 4, motive device 170 optionally may be utilized to locate stimulation assembly 100 within an initial portion 62 of liner 58 by conveying the stimulation assembly in a generally downhole direction and along a length of liner conduit 80. Then, perforation device 120 may be utilized to form a plurality of initial perforations 63 within the initial portion of the liner, and stimulant fluid 160 may be introduced through initial perforations 63 to stimulate initial region 42 of the subterranean formation.

Figure 5:
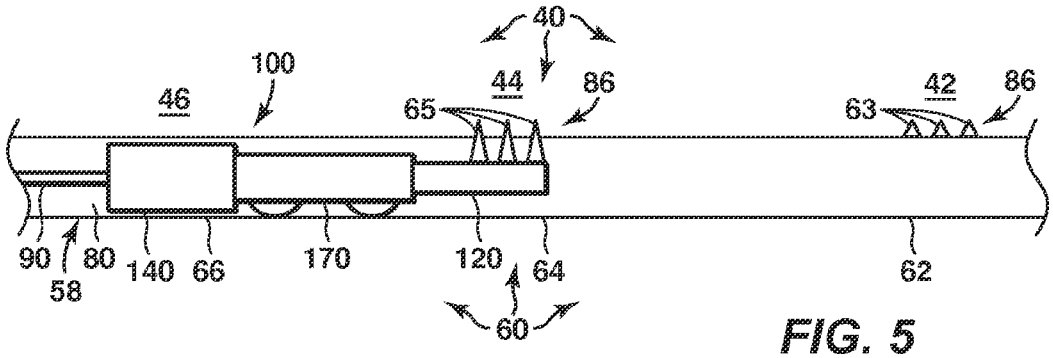

Subsequently, and as shown in FIG. 5, motive device 170 may be utilized to convey the stimulation assembly in an uphole direction and to locate the stimulation assembly within first portion 64 of liner 58. Perforation device 120 may then be utilized to form a plurality of first perforations 65 within the first portion of the liner to provide for fluid communication between the first portion of the liner and first region 44 of the subterranean formation.

Figure 6:
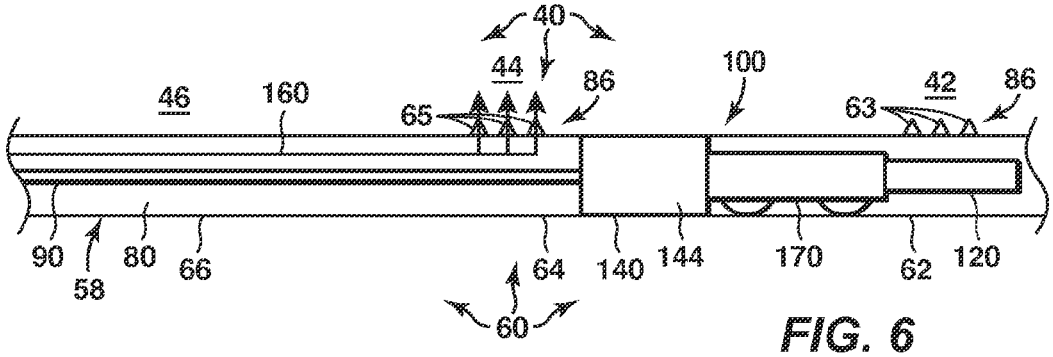

After formation of first perforations 65, and as shown in FIG. 6, motive device 170 may be utilized to convey the stimulation assembly in the downhole direction such that resettable sealing device 140 is between initial perforations 63 and first perforations 65, and the resettable sealing device may be transitioned to a sealing configuration 144 to limit a flow of stimulant fluid 160 therepast. Alternatively, wireline 90 may be utilized to pull the stimulation assembly in the uphole direction prior to transitioning the resettable sealing device to the sealing configuration. Then, stimulant fluid 160 may be introduced through first perforations 65 to stimulate first region 44 of the subterranean formation.

Figure 7:
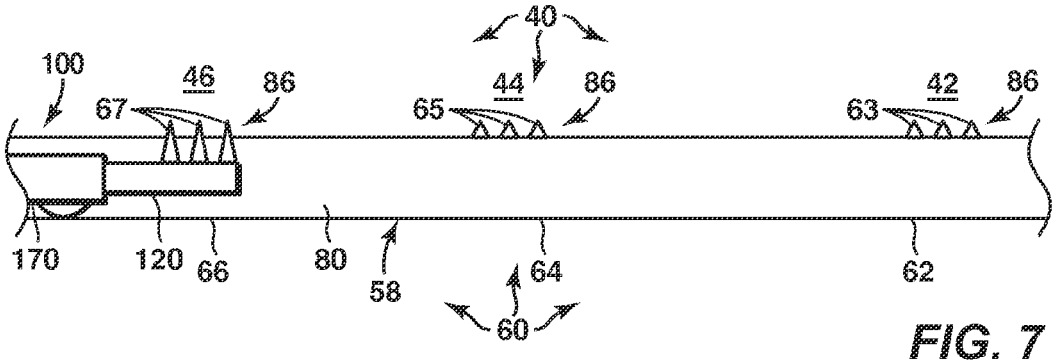
Figure 8:
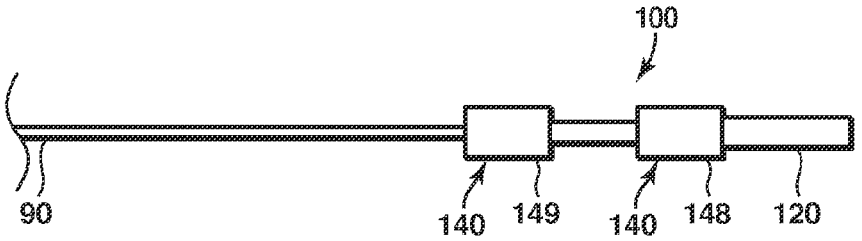
FIGS. 8-13 provide schematic representations of illustrative, non-exclusive examples of a stimulation assembly that includes a plurality of resettable sealing devices that are uphole from a perforation device.

The stimulation assembly may then be moved in an uphole direction and utilized to create a plurality of second perforations 67 in second portion 66 of liner 58, as shown in FIG. 7, prior to providing the stimulant fluid to second region 46 of the subterranean formation. This may include moving the stimulation assembly in the uphole direction, creating second perforations 67, moving the stimulation assembly in the downhole direction, transitioning the resettable sealing device to the sealing configuration, and introducing the stimulant fluid through the second perforations in a substantially similar manner to that discussed in more detail herein with reference to FIGS. 5-6.

FIGS. 8-13 provide schematic representations of illustrative, non-exclusive examples of a stimulation assembly 100 that includes a plurality of resettable sealing devices 140 in the form of a first resettable sealing device 148 and a second resettable sealing device 149 that are spaced apart from one another and uphole from a perforation device 120. The stimulation assembly may be in mechanical and/or electrical communication with a surface region, a controller, and/or a remainder of the stimulation assembly via a wireline 90. As shown in FIGS. 9-13, the stimulation assembly may be inserted into a liner 58, or liner conduit 80 thereof, and utilized to form a plurality of perforations 86 within a plurality of portions 60 of the liner and/or to stimulate a plurality of regions 40 of a subterranean formation.

As shown in FIG. 9, inserting the stimulation assembly into liner 58 and/or locating the stimulation assembly within an initial portion 62 of liner 58 may include expanding second resettable sealing device 149 to a motive configuration 142, contracting first resettable sealing device 148 to a contracted configuration 146, and providing a motive fluid 165 to liner conduit 80 to move, convey, or otherwise flow the stimulation assembly in the downhole direction. As discussed in more detail herein, in the motive configuration, the outer diameter of the second resettable sealing device may be within a maximum threshold fraction of a diameter of the liner conduit. In this configuration, the second resettable sealing device may move freely, or at least substantially freely, within the liner conduit; however, flow of motive fluid 165 past the second resettable sealing device may be partially obstructed. Thus, flow of motive fluid 165 will generate a pressure differential across the second resettable sealing device, which may provide a motive force to convey the stimulation assembly in the downhole direction.

Figure 10:
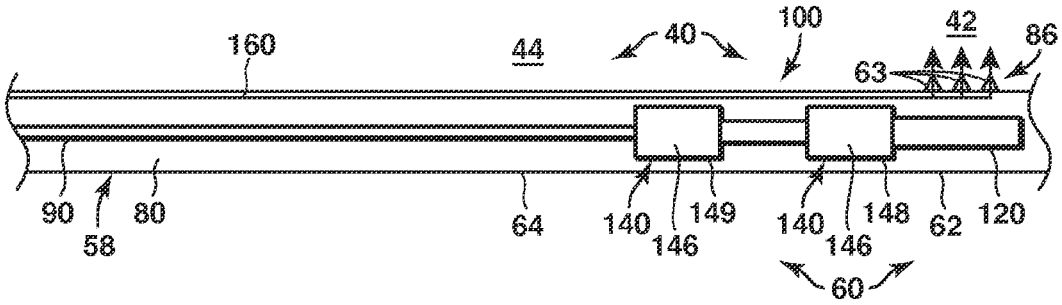

Once the stimulation assembly reaches initial portion 62 of the liner, and as shown in FIG. 10, perforation device 120 may be utilized to form a plurality of initial perforations 63 within liner 58, first resettable sealing device 148 and/or second resettable sealing device 149 may be transitioned to and/or retained in contracted configuration 146, and stimulant fluid 160 may be introduced through initial perforations 63 to stimulate initial region 42 of the subterranean formation.

Figure 11:
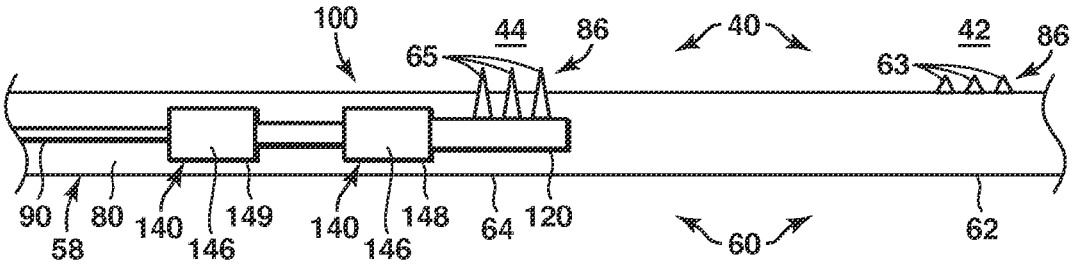

Subsequently, and with first resettable sealing device 148 and second resettable sealing device 149 retained in contracted configuration 146, stimulation assembly 100 may be pulled in an uphole direction with wireline 90 to locate the stimulation assembly within first portion 64 of liner 58, as shown in FIG. 11. Then, perforation device 120 may be utilized to form a plurality of first perforations 65 within liner 58.

Figure 13:
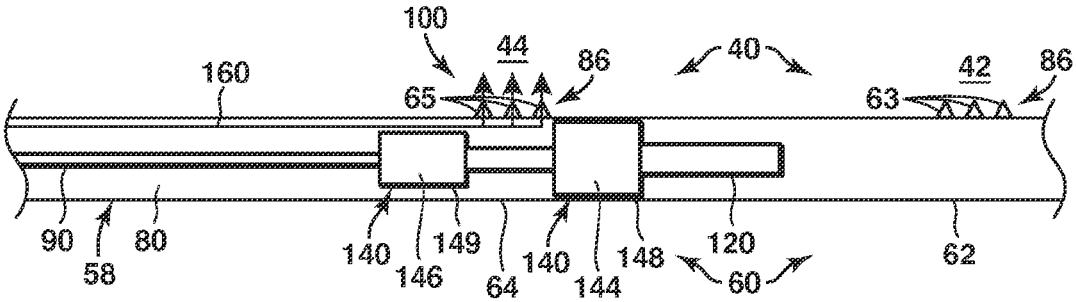
Figure 14:
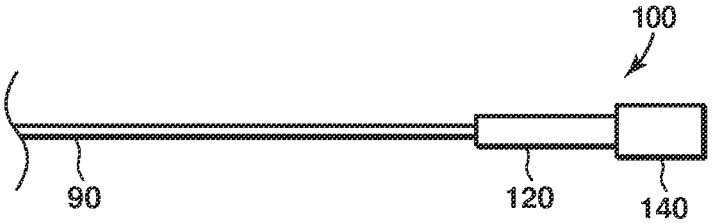
FIGS. 14-20 provide schematic representations of illustrative, non-exclusive examples of a stimulation assembly that includes a perforation device that is uphole from a resettable sealing device.

After formation of the plurality of second perforations, and as shown in FIG. 12, second resettable sealing device 149 may be transitioned to motive configuration 142, first resettable sealing device 148 may be transitioned to and/or retained in contracted configuration 146, and motive fluid 165 may be provided to liner conduit 80 to convey stimulation assembly 100 in the downhole direction such that first perforations 65 are between first resettable sealing device 148 and second resettable sealing device 149. Subsequently, and as shown in FIG. 13, first resettable sealing device 148 may be expanded to sealing configuration 144, second resettable sealing device 149 may be contracted to contracted configuration 146, and stimulant fluid 160 may be introduced through first perforations 65 to stimulate first region 44 of the subterranean formation.

FIGS. 14-20 provide schematic representations of illustrative, non-exclusive examples of a stimulation assembly 100 that includes a perforation device 120 that is uphole from a resettable sealing device 140. The stimulation assembly may be in mechanical and/or electrical communication and/or connection with a surface region, a controller, and/or a remainder of the stimulation assembly via a wireline 90. As shown in FIGS. 15-20, the stimulation assembly may be inserted into a liner 58, or liner conduit 80 thereof, and utilized to form a plurality of perforations 86 within a plurality of portions 60 of the liner and to stimulate a plurality of regions 40 of a subterranean formation.

Figure 16:
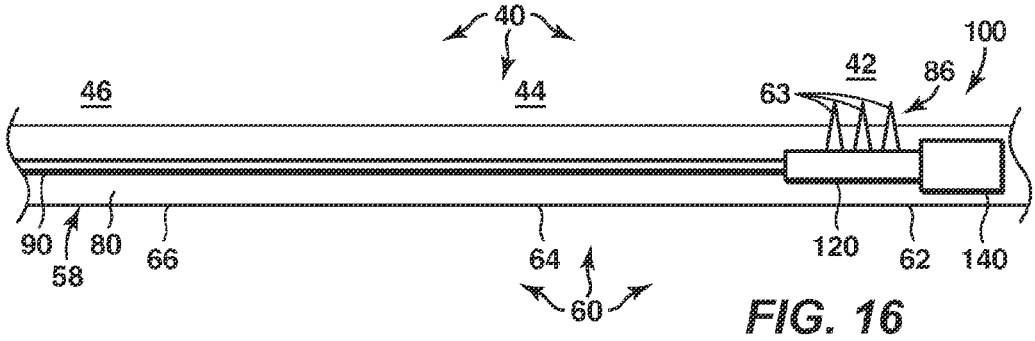
Figure 17:
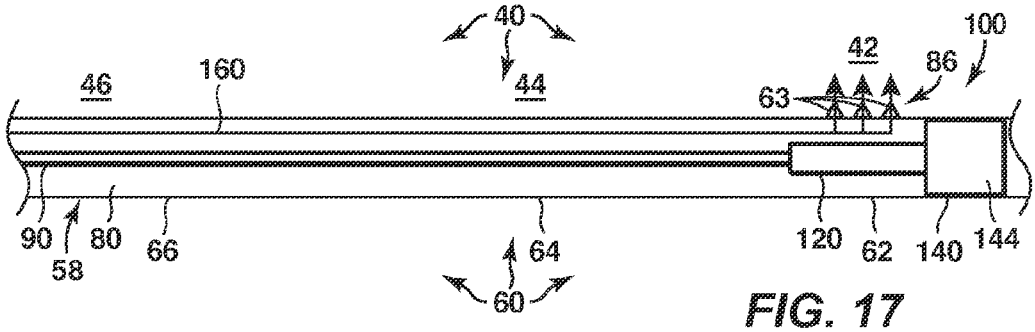

As shown in FIG. 15, the resettable sealing device may be expanded to a motive configuration 142, and a motive fluid 165 may be provided to liner conduit 80 to convey the stimulation assembly along the liner conduit and in a downhole direction. This may locate the stimulation assembly within initial portion 62 of liner 58. Subsequently, and as shown in FIG. 16, perforation device 120 may be utilized to form a plurality of initial perforations 63 within liner 58. Then, and as shown in FIG. 17, resettable sealing device 140 may be expanded to a sealing configuration 144, and stimulant fluid 160 may be introduced through initial perforations 63 and into initial region 42 of the subterranean formation to stimulate the initial region of the subterranean formation.

Figure 18:
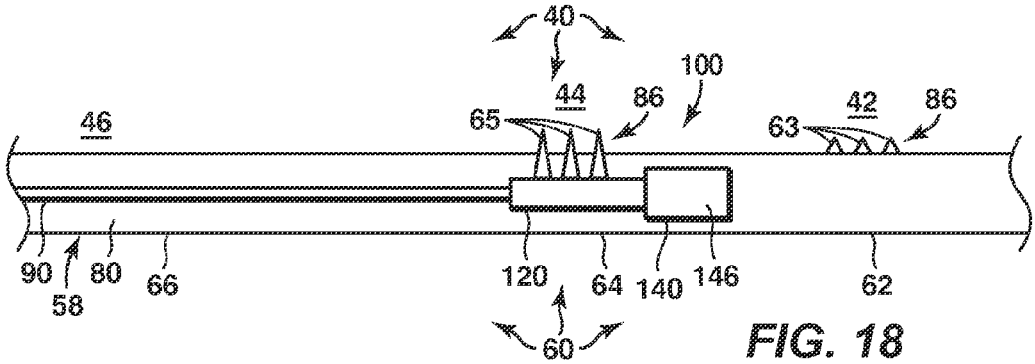
Figure 19:
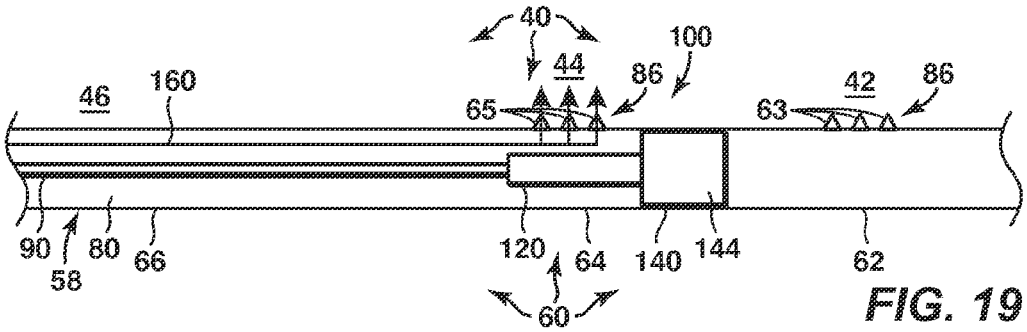

After stimulation of initial region 42, and as shown in FIG. 18, resettable sealing device 140 may be contracted to a contracted configuration 146, and wireline 90 may be utilized to pull the resettable sealing device in an uphole direction and locate the stimulation assembly within first portion 64 of liner 58. Then, perforation device 120 may be utilized to form a plurality of first perforations 65 within liner 58. Subsequently, and as shown in FIG. 19, resettable sealing device 140, which may be located between initial perforations 63 and first perforations 65, may be expanded to sealing configuration 144, and stimulant fluid 160 may be introduced through first perforations 65 and into first region 44 of the subterranean formation to stimulate the first region of the subterranean formation.

Figure 20:
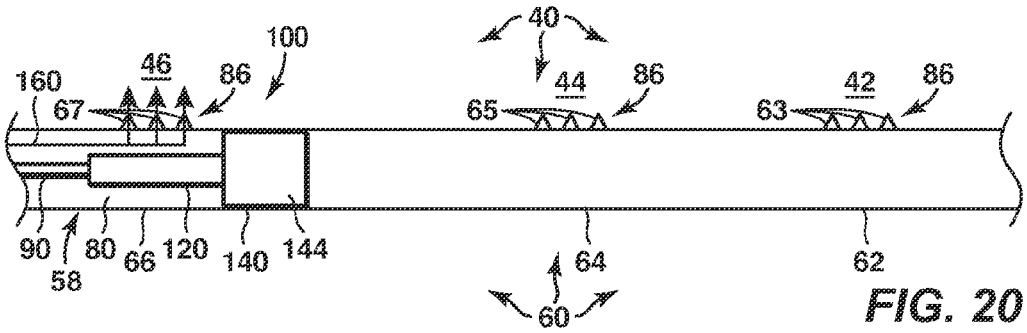

After stimulation of first region 44, the resettable sealing device may be contracted to the contracted configuration, the wireline may be utilized to pull the resettable sealing device in the uphole direction and to locate the resettable sealing device within second portion 66 of the liner, and the perforation device may be utilized to form a plurality of second perforations in the liner. Then, and as shown in FIG. 20, resettable sealing device 140 may be expanded to sealing configuration 144, and stimulant fluid may be introduced through second perforations 67 and into second region 46 of the subterranean formation to stimulate the second region of the subterranean formation.

Figure 21:
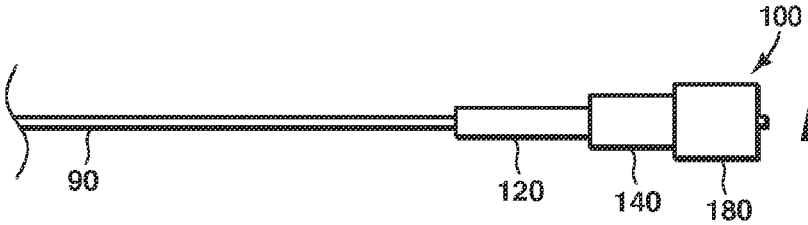
FIGS. 21-23 provide schematic representations of illustrative, non-exclusive examples of a stimulation assembly that includes a perforation device that is uphole from a resettable sealing device and a separably attached wiper plug.
Figure 22:
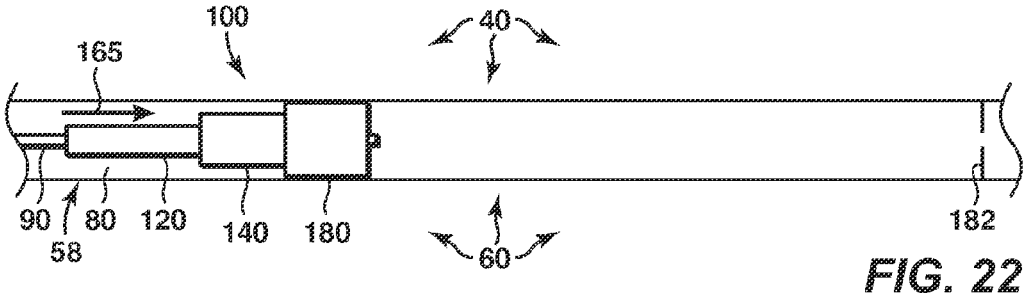
Figure 23:
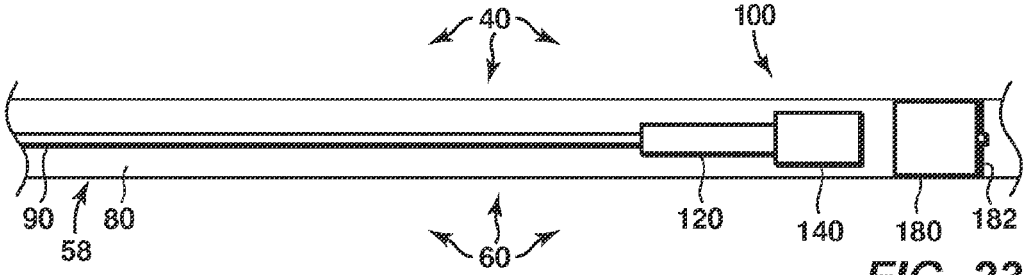

FIGS. 21-23 provide schematic representations of illustrative, non-exclusive examples of a stimulation assembly 100 that includes a perforation device 120 that is uphole from a resettable sealing device 140 and a separably attached wiper plug 180 that is positioned or otherwise located downhole from the resettable sealing device. The stimulation assembly may be in mechanical and/or electrical communication with a surface region, a controller, and/or a remainder of the stimulation assembly via a wireline 90. As shown in FIGS. 22-23, the stimulation assembly may be inserted into a liner 58, or liner conduit 80 thereof, that includes a landing collar 182 for wiper plug 180 and subsequently utilized to form a plurality of perforations within a plurality of portions 60 thereof and to stimulate a plurality of respective regions 40 of a subterranean formation.

As shown in FIG. 22, a motive fluid 165 may be provided to liner conduit 80, which may produce a pressure differential across wiper plug 180. This pressure differential may provide a motive force for conveyance of the wiper plug, and thus the attached stimulation assembly, in a downhole direction and may be utilized to locate the stimulation assembly within a desired portion of the liner. In the illustrative, non-exclusive example of FIGS. 22-23, upon contact with landing collar 182, wiper plug 180 is configured to couple to the landing collar and decouple from a remainder of the stimulation assembly, thus separating the wiper plug from the stimulation assembly. Subsequent to separation of the wiper plug from the remainder of the stimulation assembly, the stimulation assembly of FIGS. 21-23 may be utilized to form the plurality of perforations in the plurality of portions of liner 58 and to stimulate the plurality of regions of the subterranean formation in a substantially similar manner to that described herein with reference to FIGS. 16-20.

The illustrative, non-exclusive examples of process flows according to the present disclosure that are shown in FIGS. 3-23 and discussed in more detail herein may be utilized to stimulate a plurality of regions of a subterranean formation. Thus, while the process flows illustrate stimulation of an initial region of the subterranean formation, a first region of the subterranean formation, and, in the case of FIGS. 7 and 20, a second region of the subterranean formation, it is within the scope of the present disclosure that, as discussed in more detail herein with reference to the method flowchart of FIG. 2, these process flows may be repeated any suitable number of times. This may include stimulation of any suitable number of regions of the subterranean formation and/or stimulation of the plurality of regions of the subterranean formation without removal of the stimulation assembly from the liner conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A method of stimulating a subterranean formation that includes a well, wherein the well includes a wellbore and a liner that defines a liner conduit, the method comprising:

perforating, with a perforation device of a stimulation assembly, a first portion of the liner to create a first perforation, wherein the stimulation assembly includes the perforation device and a resettable sealing device coupled to the perforation device for movement with the perforation device, optionally wherein the stimulation assembly is configured to be moved as a unit uphole and downhole within the liner conduit, and further optionally wherein the stimulation assembly is mechanically connected to a surface region via a wireline, and still further optionally wherein the stimulation assembly is in electrical communication with the surface region via a/the wireline;

isolating, with the resettable sealing device, the first portion of the liner from fluid communication with a first downhole portion of the liner, wherein the isolating the first portion of the liner includes expanding the resettable sealing device to a sealing configuration with fluid from the liner conduit; and introducing a stimulant fluid from a/the surface region, through the liner conduit, and through the first perforation.

A2. The method of paragraph A1, wherein the method further comprises: at least partially contracting the resettable sealing device;

moving the stimulation assembly to a second portion of the liner, optionally wherein the second portion of the liner is uphole from the first portion of the liner, and further optionally wherein the moving includes pulling the stimulation assembly uphole with a wireline;

perforating, with the perforation device, the second portion of the liner to create a second perforation;

isolating, with the resettable sealing device, the second portion of the liner from fluid communication with a second downhole portion of the liner, wherein the isolating the second portion of the liner includes expanding the resettable sealing device to a sealing configuration with fluid from the liner conduit; and introducing the stimulant fluid from the surface region, through the liner conduit, and through the second perforation, and optionally wherein the perforating the second portion, isolating the second portion, and introducing the stimulant fluid through the second perforation are performed after the perforating the first portion, isolating the first portion, and introducing the stimulant fluid through the first perforation and without removing the stimulation assembly from the wellbore.

A3. The method of paragraph A1 or A2, wherein the method includes locating the stimulation assembly within the first portion of the liner.

A4. The method of any of paragraphs A1-A3, wherein the method includes locating the stimulation assembly within the second portion of the liner.

A5. The method of any of paragraphs A1-A4, wherein the resettable sealing device is positioned uphole from the perforation device.

A6. The method of any of paragraphs A1-A4, wherein the resettable sealing device is positioned downhole from the perforation device.

A7. The method of any of paragraphs A1-A6, wherein the stimulation assembly further includes a motive device that is configured to convey the stimulation assembly along a length of the liner conduit, wherein the method includes conveying the stimulation assembly along the length of the liner conduit with the motive device, optionally wherein the motive device includes at least one of a motorized motive device, a mechanical motive device, and a tractor, further optionally wherein the motive device is located between the resettable sealing device and the perforation device, still further optionally when dependent from paragraph A3 wherein the locating the stimulation assembly within the first portion of the liner includes conveying the stimulation assembly along the length of the first portion of the liner with the motive device, and when dependent from paragraph A4, even further optionally wherein the locating the stimulation assembly within the second portion of the liner includes conveying the stimulation assembly along the length of the second portion of the liner with the motive device.

A8. The method of paragraph A7, wherein the method includes at least one of providing an electric current to the motive device with a/the wireline and controlling the operation of the motive device with a/the wireline.

A9. The method of any of paragraphs A7-A8, wherein, subsequent to perforating the first portion of the liner and prior to isolating the first portion of the liner, the method further includes moving the resettable sealing device downhole of the first perforation with the motive device.

A10. The method of any of paragraphs A7-A9, when dependent from paragraph A4, wherein locating the stimulation assembly within the second portion of the liner includes at least one of moving the stimulation assembly uphole with the motive device and pulling the stimulation assembly uphole with a/the wireline.

A11. The method of any of paragraphs A7-A10, when dependent from paragraph A4, wherein, subsequent to perforating the second portion of the liner and prior to isolating the second portion of the liner, the method further includes moving the resettable sealing device downhole of the second perforation with the motive device.

A12. The method of any of paragraphs A1-A11, wherein the resettable sealing device is a first resettable sealing device, wherein the stimulation assembly further includes a second resettable sealing device that is uphole and spaced apart from the first resettable sealing device but coupled to the first resettable sealing device for movement with the first resettable sealing device uphole and downhole within the liner conduit, and optionally wherein the perforation device is downhole from both the first resettable sealing device and the second resettable sealing device.

A13. The method of paragraph A12, when dependent from paragraph A3, wherein the locating the stimulation assembly within the first portion of the liner includes expanding the second resettable sealing device to a motive configuration and providing a motive fluid into the liner conduit to convey the stimulation assembly along the liner conduit.

A14. The method of any of paragraphs A12-A13, when dependent from paragraph A3, wherein locating the stimulation assembly within the first portion of the liner includes contracting the first resettable sealing device to a contracted configuration and includes pulling the stimulation assembly in an uphole direction with a/the wireline.

A15. The method of any of paragraphs A12-A14, when dependent from paragraph A3, wherein isolating the first portion of the liner includes expanding the second resettable sealing device to a/the motive configuration, providing a/the motive fluid into the liner conduit to convey the stimulation assembly downhole until the first resettable sealing device is downhole from the first perforation, contracting the second resettable sealing device to a/the contracted configuration, and expanding the first resettable sealing device to a sealing configuration.

A16. The method of any of paragraphs A12-A15, when dependent from paragraph A4, wherein locating the stimulation assembly within the second portion of the liner includes contracting the first resettable sealing device to a/the contracted configuration and pulling the stimulation assembly in an/the uphole direction with a/the wireline.

A17. The method of any of paragraphs A12-A16, when dependent from paragraph A4, wherein isolating the second portion of the liner includes expanding the second resettable sealing device to a/the motive configuration, providing a/the motive fluid into the liner conduit to convey the first resettable sealing device downhole from the second perforation and uphole from the first perforation, contracting the first resettable sealing device to a/the contracted configuration, and expanding the first resettable sealing device to a/the sealing configuration.

A18. The method of any of paragraphs A1-A17, wherein the method includes expanding the resettable sealing device to a motive configuration and providing a motive fluid into the liner conduit to convey the stimulation assembly along the liner conduit, and optionally when dependent from paragraph A3, wherein the locating the stimulation assembly within the first portion of the liner includes expanding the resettable sealing device to the motive configuration and providing the motive fluid into the liner conduit to convey the stimulation assembly along the liner conduit, and further optionally when dependent from paragraph A4, wherein the locating the stimulation assembly within the second portion of the liner includes expanding the resettable sealing device to the motive configuration and providing the motive fluid into the liner conduit to convey the stimulation assembly along the liner conduit.

A19. The method of any of paragraphs A1-A18, wherein the stimulation assembly is separably attached to, and optionally includes, a wiper plug, wherein the wiper plug is positioned downhole from the resettable sealing device, wherein the well includes a landing collar for the wiper plug, wherein the method includes providing a/the motive fluid into the liner conduit to convey the stimulation assembly and the wiper plug downhole and into contact with the landing collar, and further wherein the method includes coupling the wiper plug to the landing collar and decoupling the wiper plug from the stimulation assembly, and optionally when dependent from paragraph A3, the locating the stimulation assembly within the first portion of the liner includes providing the motive fluid into the liner conduit to convey the stimulation assembly and the wiper plug downhole and into contact with the landing collar.

A20. The method of any of paragraphs A1-A19, wherein the method includes contracting the resettable sealing device to a contracted configuration and includes pulling the stimulation assembly in an uphole direction with a/the wireline, and when dependent from paragraph A3, optionally wherein locating the stimulation assembly within the first portion of the liner includes contracting the resettable sealing device to the contracted configuration and includes pulling the stimulation assembly in an uphole direction with the wireline, and/or further optionally when dependent from paragraph A4, wherein locating the stimulation assembly within the second portion of the liner includes contracting the resettable sealing device to the contracted configuration and includes pulling the stimulation assembly in an uphole direction with the wireline.

A21. The method of any of paragraphs A1-A20, wherein the stimulation assembly includes a pump, wherein isolating the first portion of the liner includes expanding the resettable sealing device to a sealing configuration with fluid from the liner conduit that is pumped into the resettable sealing device by the pump, and optionally wherein isolating the second portion of the liner includes expanding the resettable sealing device to the sealing configuration with fluid from the liner conduit that is pumped into the resettable sealing device by the pump.

A22. The method of paragraph A4 or any of paragraphs A6-A21 when dependent from paragraph A4, wherein isolating the second portion of the liner includes expanding the resettable sealing device to a/the sealing configuration in a region of the liner that is between the first perforation and the second perforation.

A23. The method of any of paragraphs A1-A22, wherein the method includes moving the stimulation assembly along the liner conduit by gravitational force, and optionally, when dependent from paragraph A3, wherein the locating the stimulation assembly within the first portion of the liner includes moving the stimulation assembly along the liner conduit by gravitational force, and further optionally when dependent from paragraph A4, wherein locating the stimulation assembly within the second portion of the liner includes moving the stimulation assembly along the liner conduit by gravitational force.

A24. The method of any of paragraphs A1-A23, wherein the perforating includes creating at least one perforation in the liner, and optionally wherein the perforation includes at least one of a hole, a slit, an opening, and a void.

A25. The method of any of paragraphs A1-A24, wherein the perforation device includes a perforating gun that includes a plurality of perforation charges configured to create a plurality of perforations in the liner, and further wherein the perforating includes discharging at least one of the plurality of perforation charges to create at least one perforation in the liner.

A26. The method of any of paragraphs A1-A25, wherein the isolating includes pumping fluid from the liner conduit into the resettable sealing device to expand the resettable sealing device to a/the sealing configuration.

A27. The method of paragraph A26, wherein the fluid is and/or includes fluid that is drawn from proximate the stimulation assembly.

A28. The method of any of paragraphs A26-A27, wherein expanding the resettable sealing device to the sealing configuration includes increasing an outer diameter of the resettable sealing device and contacting an inner circumference of the liner conduit with an outer circumference of the resettable sealing device.

A29. The method of any of paragraphs A1-A28, wherein the isolating includes resisting a flow of fluid past the resettable sealing device.

A30. The method of any of paragraphs A1-A29, wherein the isolating includes resisting a pressure differential across the resettable sealing device of at least 10 megapascals (MPa), at least 15 MPa, at least 20 MPa, at least 25 MPa, at least 30 MPa, at least 35 MPa, at least 40 MPa, at least 45 MPa, or at least 50 MPa without relative motion between the liner and the resettable sealing device.

A31. The method of any of paragraphs A1-A30, wherein the isolating includes blocking at least 75%, at least 80%, at least 85%, at least 90%, at least 95%, at least 97.5%, at least 99%, at least 99.9%, or substantially all of a cross-sectional area of the liner with the resettable sealing device.

A32. The method of any of paragraphs A1-A31, wherein the resettable sealing device includes at least one of a bridge plug, a through tubing bridge plug, a through tubing inflatable bridge plug, a resettable bridge plug, an inflatable bridge plug, an expandable bridge plug, a selectively expandable and contractible bridge plug, and a sealing device that is configured to selectively expand and contract a plurality of times while it is within the liner conduit.

A33. The method of any of paragraphs A13, A15, or A17-A18, wherein expanding the resettable sealing device to the motive configuration includes expanding the resettable sealing device such that an outer diameter of the resettable sealing device is within a maximum threshold fraction of a diameter of the liner conduit, and optionally wherein the maximum threshold fraction is at least 50%, at least 60%, at least 70%, at least 75%, at least 80%, at least 85%, at least 90%, or at least 95%, and optionally less than 99%, less than 97.5%, less than 95%, less than 92.5%, or less than 90% of the diameter of the liner conduit.

A34. The method of any of paragraphs A14-A17, or A20, wherein contracting the resettable sealing device to the contracted configuration includes contracting the resettable sealing device such that an outer diameter of the resettable sealing device is at most a minimum threshold fraction of a diameter of the liner conduit, and optionally wherein the minimum threshold fraction is less than 75%, less than 70%, less than 60%, less than 50%, less than 40%, or less than 30% of the diameter of the liner conduit.

A35. The method of any of paragraphs A1-A34, wherein the introducing includes supplying at least one of the stimulant fluid and the motive fluid to an end of the liner conduit that is present within the surface region, optionally wherein the supplying includes pumping, and further optionally wherein the supplying includes bullheading.

A36. The method of any of paragraphs A1-A35, wherein, prior to perforating the first portion of the liner, and when dependent from paragraph A3, prior to locating the stimulation assembly within the first portion of the liner, the method further includes:

perforating, with the perforation device, an initial portion of the liner to create an initial perforation; and introducing the stimulant fluid from the surface region into the liner conduit and through the initial perforation, and optionally wherein prior to perforating the initial portion of the liner, the method includes locating the stimulation assembly within the initial portion of the liner.

A37. The method of any of paragraphs A1-A36, wherein the first portion of the liner is downhole from the second portion of the liner.

A38. The method of any of paragraphs A1-A37, wherein the method further includes repeating the method in a subsequent portion of the liner to create a subsequent perforation and introducing the stimulant fluid through the subsequent perforation, optionally wherein the subsequent portion of the liner is uphole from the second portion of the liner.

A39. The method of paragraph A38, wherein the repeating includes sequentially perforating a plurality of portions of the liner to create a plurality of perforations and introducing the stimulant fluid through the plurality of perforations, and optionally wherein each successive portion of the liner is uphole from a preceding portion of the liner.

A40. The method of any of paragraphs A1-A39, wherein the liner includes a plurality of portions, and further wherein the plurality of portions includes at least 10, at least 15, at least 20, at least 25, at least 30, at least 35, at least 40, at least 45, at least 50, at least 55, at least 60 at least 65, or at least 70 portions, and further wherein the method includes repeating the method in each of the plurality of portions.

A41. The method of any of paragraphs A38-A40, wherein the repeating includes repeating the method without removing the stimulation assembly from the liner conduit.

A42. The method of any of paragraphs A1-A41, wherein the method further includes selecting a distance between the first perforation and the second perforation, wherein locating the stimulation assembly within the second portion of the liner is based, at least in part, on the selecting, and optionally wherein the selecting occurs after the introducing the stimulant fluid through the first perforation.

A43. The method of paragraph A42, wherein the selecting is based, at least in part, on at least one of a/the length of the liner conduit, a/the diameter of the liner conduit, a flow rate of the stimulant fluid during the introducing, a supply pressure of the stimulant fluid during the introducing, a diameter of the first perforation, a nature of the subterranean formation, and/or a chemical composition of the stimulant fluid.

A44. The method of any of paragraphs A1-A43, wherein the method further includes drilling the wellbore.

A45. The method of any of paragraphs A1-A44, wherein the method further includes placing the liner within the wellbore.

A46. The method of any of paragraphs A1-A45, wherein the method further includes cementing the liner within the wellbore.

A47. The method of any of paragraphs A1-A46, wherein the stimulation assembly includes a/the wireline.

A48. The method of any of paragraphs A1-A47, wherein the introducing includes fracturing a region of the subterranean formation that is proximal to a perforation through which the stimulant fluid flows.

A49. The method of any of paragraphs A1-A48, wherein the introducing includes acid treating a/the region of the subterranean formation that is proximal to a/the perforation through which the stimulant fluid flows.

A50. The method of any of paragraphs A1-A49, wherein the method further includes placing the stimulation assembly within the liner conduit.

A51. The method of any of paragraphs A1-A50, wherein the method does not include using coiled tubing to deliver fluid to the stimulation assembly and/or to the perforations.

B1. A stimulation assembly for stimulating a subterranean formation that includes a well, wherein the well includes a wellbore and a liner that defines a liner conduit, the stimulation assembly comprising:

a perforation device configured to form one or more perforations within a plurality of portions of the liner;

a resettable sealing device coupled to the perforation device for movement with the perforation device along the liner conduit, configured to isolate an uphole portion of the liner from fluid communication with a downhole portion of the liner, and further configured to direct a stimulant fluid, which is introduced directly into the liner conduit, through one or more perforations that are uphole from the resettable sealing device;

wherein the resettable sealing device is configured to be selectively inflated with fluid from the liner conduit; and wherein the stimulation assembly is coupled to a wireline that is configured to establish at least one of a mechanical connection and electrical communication between the stimulation assembly and a surface region.

B2. The stimulation assembly of paragraph B1, wherein the resettable sealing device is positioned uphole from the perforation device.

B3. The stimulation assembly of paragraph B1, wherein the resettable sealing device is positioned downhole from the perforation device.

B4. The stimulation assembly of any of paragraphs B1-B3, wherein the stimulation assembly further includes a motive device that is configured to convey the stimulation assembly along a length of the liner conduit, optionally wherein the motive device includes at least one of a motorized motive device, a mechanical motive device, an electrically powered motive device, and a tractor, and further optionally wherein the motive device is positioned between the resettable sealing device and the perforation device.

B5. The stimulation assembly of any of paragraphs B1-B4, wherein the resettable sealing device is a first resettable sealing device, wherein the stimulation assembly further includes a second resettable sealing device that is uphole and spaced apart from the first resettable sealing device and coupled to the first resettable sealing device and the perforation device for movement along the liner conduit, optionally wherein the perforation device is downhole from both the first resettable sealing device and the second resettable sealing device.

B6. The stimulation assembly of paragraph B5, wherein the second resettable sealing device is configured to be expanded to a motive configuration to increase a resistance to a fluid flow therepast and to create a pressure differential thereacross responsive to flow of a motive fluid therepast, wherein the pressure differential provides a motive force for motion of the stimulation assembly within the liner conduit.

B7. The stimulation assembly of any of paragraphs B5-B6, wherein the first resettable sealing device is configured to be expanded to a sealing configuration to isolate the uphole portion of the liner from the downhole portion of the liner.

B8. The stimulation assembly of any of paragraphs B1-B7, wherein the stimulation assembly is separably attached to, and optionally includes, a wiper plug, wherein the wiper plug is positioned downhole from the resettable sealing device, wherein the well includes a landing collar for the wiper plug, and further wherein the wiper plug is configured to couple to the landing collar, and decouple from the stimulation assembly, or a remainder of the stimulation assembly, upon contact with the landing collar.

B9. The stimulation assembly of any of paragraphs B1-B8, wherein the stimulation assembly is configured to form the one or more perforations within each of the plurality of portions of the liner without being removed from the liner conduit, and optionally wherein the plurality of portions of the liner includes at least 5, at least 10, at least 15, at least 20, at least 25, at least 30, at least 35, at least 40, at least 45, at least 50, at least 55, at least 60, at least 65, or at least 70 portions of the liner.

B10. The stimulation assembly of any of paragraphs B1-B9, wherein the stimulation assembly includes the wireline.

B11. The stimulation assembly of any of paragraphs B1-B10, wherein the wireline is configured to provide a mechanical connection and electrical communication between a surface region and the stimulation assembly.

B12. The stimulation assembly of any of paragraphs B1-B11, wherein the wireline is configured to provide an electric current to the perforation device and/or the resettable sealing device, and optionally wherein the electric current is configured to control the operation of the perforation device and/or the resettable sealing device.

B13. The stimulation assembly of any of paragraphs B1-B12, wherein the wireline is configured to selectively provide a/the motive force to the stimulation assembly to convey the stimulation assembly in an uphole direction.

B14. The stimulation assembly of any of paragraphs B1-B13, wherein the perforation device includes a perforating gun that includes a plurality of perforation charges configured to create the one or more perforations within the plurality of portions of the liner.

B15. The stimulation assembly of any of paragraphs B1-B14, wherein the resettable sealing device includes at least one of a bridge plug, a through tubing bridge plug, a through tubing inflatable bridge plug, a resettable bridge plug, an inflatable bridge plug, an expandable bridge plug, a selectively expandable and contractible bridge plug, and a sealing device that is configured to selectively expand and contract a plurality of times while it is within the liner conduit.

B16. The stimulation assembly of any of paragraphs B1-B15, wherein at least one of the resettable sealing device and the stimulation assembly includes a pump that is configured to convey a fluid between an interior of the resettable sealing device and an exterior of the resettable sealing device to selectively expand or contract the resettable sealing device, and optionally wherein the fluid is and/or includes at least one of a reservoir fluid that is drawn from the subterranean formation and a wellbore fluid that is drawn from within the wellbore.

B17. The stimulation assembly of paragraph B16, wherein the pump is configured to expand the resettable sealing device by increasing a volume of the fluid that is in the interior of the resettable sealing device.

B18. The stimulation assembly of any of paragraphs B16-B17, wherein the pump is configured to contract the resettable sealing device by decreasing a/the volume of the fluid that is in the interior of the resettable sealing device.

B19. The stimulation assembly of any of paragraphs B16-B18, wherein the pump is configured to selectively expand and contract the resettable sealing device responsive to receipt of an/the electric current.

B20. The stimulation assembly of any of paragraphs B1-B19, wherein the stimulation assembly further includes a controller configured and/or programmed to control the operation of the stimulation assembly, optionally wherein the controller is configured and/or programmed to perform the method of any of paragraphs A1-A51.

B21. The stimulation assembly of paragraph B20, wherein the controller is configured and/or programmed to provide a perforation signal to the perforation device while the perforation device is within each of the plurality of portions of the liner, and further wherein the perforation device is configured to form the one or more perforations within each of the plurality of portions of the liner responsive, at least in part, to receipt of the perforation signal.

B22. The stimulation assembly of any of paragraphs B20-B21, wherein the controller is configured and/or programmed to provide an isolation signal to the resettable sealing device while the resettable sealing device is within each of the plurality of portions of the liner, and further wherein the resettable sealing device is configured to isolate a present portion of the liner from one or more downhole portions of the liner responsive, at least in part, to receipt of the isolation signal.

B23. The stimulation assembly of any of paragraphs B20-B22, wherein the controller is configured and/or programmed to selectively control the operation of the perforation device to form the one or more perforations within each of the plurality of portions of the liner and to selectively isolate each of a/the present portions of the liner from each of a/the one or more downhole portions of the liner without removal of the perforation device or the resettable sealing device from the liner conduit, optionally wherein the plurality of portions of the liner includes at least 3, at least 5, at least 10, at least 15, at least 20, at least 25, at least 30, at least 35, at least 40, at least 45, at least 50, at least 55, at least 60, at least 65, or at least 70 portions of the liner.

C1. A hydrocarbon well, wherein the hydrocarbon well includes:

a liner, wherein the liner contains the stimulation assembly of any of paragraphs B1-B23.

C2. The hydrocarbon well of paragraph C1, wherein the hydrocarbon well further includes the wellbore.

C3. The hydrocarbon well of any of paragraphs C1-C2, wherein the liner is in fluid communication with a pump that is configured to at least one of introduce and bullhead at least one of a/the stimulant fluid and a/the motive fluid into the liner conduit.

C4. The hydrocarbon well of paragraph C3, wherein the subterranean formation contains a hydrocarbon, optionally wherein the hydrocarbon includes at least one of shale oil and petroleum, and further optionally wherein the hydrocarbon well includes the subterranean formation.

C5. The hydrocarbon well of any of paragraphs C1-C4, wherein the subterranean formation includes at least one of an oil shale formation and a carbonate formation.

D1. The method of any of paragraphs A1-A51, wherein the stimulation assembly includes the stimulation assembly of any of paragraphs B1-B23.

D2. Hydrocarbons produced by the method of any of paragraphs A1-A51, the stimulation assembly of any of paragraphs B1-B23, or the hydrocarbon well of any of paragraphs C1-C5.

E1. The method of any of paragraphs A1-A51, the stimulation assembly of any of paragraphs B1-B23, or the hydrocarbon well of any of paragraphs C1-C5, wherein at least a subset of the plurality of portions of the liner includes a longitudinal length of at least 1 meter (m), at least 3 m, at least 5 m, at least 10 m, at least 20 m, at least 30 m, at least 40 m, at least 50 m, at least 60 m, at least 70 m, at least 80 m, at least 90 m, or at least 100 m and/or a longitudinal length of less than 300 m, less than 250 m, less than 200 m, less than 150 m, less than 125 m, less than 100 m, less than 90 m, less than 80 m, less than 70 m, or less than 60 m.

E2. The method of any of paragraphs A1-A51 or E1, the stimulation assembly of any of paragraphs B1-B23 or E1, or the hydrocarbon well of any of paragraphs C1-C5 or E1, wherein at least a/the subset of the plurality of portions of the liner includes a/the plurality of perforations, and optionally wherein the plurality of perforations includes at least 2, at least 3, at least 4, at least 5, at least 6, at least 7, or at least 8 perforations.

E3. The method of any of paragraphs E1-E2, the stimulation assembly of any of paragraphs E1-E2, or the hydrocarbon well of any of paragraphs E1-E2, wherein the subset of the plurality of portions of the liner includes a majority, at least 60%, at least 70%, at least 80%, at least 90%, at least 95%, at least 99%, or all of the plurality of portions of the liner.

E4. The method of any of paragraphs A1-A51 or E1-E3, the stimulation assembly of any of paragraphs B1-B23 or E1-E3, or the hydrocarbon well of any of paragraphs C1-C5 or E1-E3, wherein a length of the liner is at least 5 kilometers (km), at least 7.5 km, at least 10 km, at least 12.5 km, at least 15 km, at least 20 km, or at least 25 km.

E5. The method of any of paragraphs A1-A51 or E1-E4, the stimulation assembly of any of paragraphs B1-B23 or E1-E4, or the hydrocarbon well of any of paragraphs C1-C5 or E1-E4, wherein the plurality of portions of the liner include an overall length, and further wherein the overall length is at least 1,000 meters (m), at least 1,250 m, at least 1,500 m, at least 1,750 m, at least 2,000 m, at least 2,250 m, at least 2,500 m, at least 2,750 m, at least 3,000 m, at least 3,250 m, at least 3,500 m, at least 3,750 m, at least 4,000 m, at least 4,250 m, at least 4,500 m, at least 4,750 m, or at least 5,000 m.

E6. The method of any of paragraphs A1-A51 or E1-E5, the stimulation assembly of any of paragraphs B1-B23 or E1-E5, or the hydrocarbon well of any of paragraphs C1-C5 or E1-E5, wherein at least a portion of the wellbore includes an at least substantially horizontal wellbore, and optionally wherein the portion of the wellbore includes at least 10%, at least 25%, at least 50%, at least 60%, at least 70%, at least 75%, at least 80%, or at least 90%.

E7. The method of any of paragraphs A1-A51 or E1-E6, the stimulation assembly of any of paragraphs B1-B23 or E1-E6, or the hydrocarbon well of any of paragraphs C1-C5 or E1-E6, wherein the stimulant fluid includes at least one of water, a proppant, and an acid solution.

E8. The method of any of paragraphs A1-A51 or E1-E7, the stimulation assembly of any of paragraphs B1-B23 or E1-E7, or the hydrocarbon well of any of paragraphs C1-C5 or E1-E7, wherein the well includes a/the hydrocarbon well, and optionally wherein the subterranean formation includes at least one of an/the oil shale formation and a/the carbonate formation.

E9. The method of any of paragraphs A1-A51 of E1-E8, the stimulation assembly of any of paragraphs B1-B23 or E1-E8, or the hydrocarbon well of any of paragraphs C1-C5 or E1-E8, wherein a/the longitudinal length of a/the first portion of the liner is different from the longitudinal length of a/the second portion of the liner.

F1. The use of any of the methods of any of paragraphs A1-A51 or E1-E9 with any of the stimulation assemblies of any of paragraphs B1-B23 or E1-E9 or any of the hydrocarbon wells of any of paragraphs C1-C5 or E1-E9.

F2. The use of any of the stimulation assemblies of any of paragraphs B1-B23 or E1-E9 or any of the hydrocarbon wells of any of paragraphs C1-C5 or E1-E9 with any of the methods of any of paragraphs A1-A51 or E1-E9.

F3. The use of any of the methods of any of paragraphs A1-A51 or E1-E9, any of the stimulation assemblies of any of paragraphs B1-B23 or E1-E9, or any of the hydrocarbon wells of any of paragraphs C1-C5 or E1-E9 to perforate a liner.

F4. The use of any of the methods of any of paragraphs A1-A51 or E1-E9, any of the stimulation assemblies of any of paragraphs B1-B23 or E1-E9, or any of the hydrocarbon wells of any of paragraphs C1-C5 or E1-E9 to stimulate a hydrocarbon well.

F5. The use of any of the methods of any of paragraphs A1-A51 or E1-E9, any of the stimulation assemblies of any of paragraphs B1-B23 or E1-E9, or any of the hydrocarbon wells of any of paragraphs C1-C5 or E1-E9 to provide a stimulant fluid to a selected region of a subterranean formation.

F6. The use of any of the methods of any of paragraphs A1-A51 or E1-E9, any of the stimulation assemblies of any of paragraphs B1-B23 or E1-E9, or any of the hydrocarbon wells of any of paragraphs C1-C5 or E1-E9 to perforate a plurality of portions of a liner and stimulate a plurality of regions of a subterranean formation without removal of a perforation device from a liner conduit of a liner that is present within the subterranean formation.

F7. The use of a stimulation assembly, which includes a perforation device and a resettable sealing device coupled to the perforation device for movement with the perforation device, to introduce a stimulant fluid into a selected region of a subterranean formation without removal of the stimulation assembly from a liner conduit of a liner that is present within the subterranean formation.

F8. The use of a stimulation assembly, which includes a perforation device and a resettable sealing device coupled to the perforation device for movement with the perforation device, to complete and stimulate a hydrocarbon well without the use of coiled tubing to provide a stimulant fluid to a subterranean formation that is associated with the hydrocarbon well.

F9. The use of a stimulation assembly, which includes a perforation device and a resettable sealing device coupled to the perforation device for movement with the perforation device, to complete and stimulate a hydrocarbon well without the use of coiled tubing to provide a fluid to the resettable sealing device to expand the resettable sealing device to a sealing configuration.

PCT1. A method of stimulating a subterranean formation that includes a well, wherein the well includes a wellbore and a liner that defines a liner conduit, the method comprising:

perforating, with a perforation device of a stimulation assembly, a first portion of the liner to create a first perforation, wherein the stimulation assembly includes the perforation device and a resettable sealing device coupled to the perforation device for movement with the perforation device;

isolating, with the resettable sealing device, the first portion of the liner from fluid communication with a first downhole portion of the liner, wherein the isolating the first portion of the liner includes expanding the resettable sealing device to a sealing configuration with fluid from the liner conduit;

introducing a stimulant fluid from the surface region, through the liner conduit, and through the first perforation;

at least partially contracting the resettable sealing device;

moving the stimulation assembly to a second portion of the liner;

perforating, with the perforation device, the second portion of the liner to create a second perforation;

isolating, with the resettable sealing device, the second portion of the liner from fluid communication with a second downhole portion of the liner, wherein the isolating the second portion of the liner includes expanding the resettable sealing device to a sealing configuration with fluid from the liner conduit; and introducing the stimulant fluid from the surface region, through the liner conduit, and through the second perforation.

PCT2. The method of paragraph PCT1, wherein prior to perforating the first portion of the liner, the method further comprises locating the stimulation assembly within the first portion of the liner, and prior to perforating the second portion of the liner, the method further comprises locating the stimulation assembly within the second portion of the liner.

PCT3. The method of paragraph PCT2, wherein:

the resettable sealing device is positioned uphole from the perforation device;

the stimulation assembly includes a motive device that is configured to convey the stimulation assembly along a length of the liner conduit;

the locating the stimulation device within the first portion of the liner includes conveying the stimulation assembly along the length of the liner conduit with the motive device;

subsequent to perforating the first portion of the liner and prior to isolating the first portion of the liner, the method includes moving the resettable sealing device downhole of the first perforation with the motive device;

the locating the stimulation assembly within the second portion of the liner includes at least one of moving the stimulation assembly uphole with the motive device and pulling the stimulation assembly uphole with the wireline; and subsequent to perforating the second portion of the liner and prior to isolating the second portion of the liner, the method includes moving the resettable sealing device downhole of the second perforation with the motive device.

PCT4. The method of paragraph PCT1, wherein:

the resettable sealing device is a first resettable sealing device;

the stimulation assembly further includes a second resettable sealing device that is uphole and spaced apart from the first resettable sealing device but coupled to the first resettable sealing device;

the perforation device is downhole from both the first resettable sealing device and the second resettable sealing device;

prior to perforating the first portion of the liner, the method includes pumping fluid from the liner conduit into the second resettable sealing device to expand the second resettable sealing device to a motive configuration and providing a motive fluid into the liner conduit to convey the stimulation assembly along the liner conduit;

the isolating the first portion of the liner includes pumping fluid from the liner conduit into the second resettable sealing device to expand the second resettable sealing device to the motive configuration, providing the motive fluid into the liner conduit to convey the stimulation assembly downhole until the first resettable sealing device is downhole from the first perforation, contracting the second resettable sealing device to a contracted configuration, and pumping fluid from the liner conduit into the first resettable sealing device to expand the first resettable sealing device to a sealing configuration;

prior to perforating the second portion of the liner, the method further includes contracting the first resettable sealing device to the contracted configuration and pulling the stimulation assembly in an uphole direction with the wireline; and the isolating the second portion of the liner includes pumping fluid from the liner conduit into the second resettable sealing device to expand the second resettable sealing device to the motive configuration, providing the motive fluid into the liner conduit to convey the first resettable sealing device downhole from the second perforation and uphole from the first perforation, contracting the second resettable sealing device to the contracted configuration, and pumping fluid from the liner conduit into the first resettable sealing device to expand the first resettable sealing device to the sealing configuration.

PCT5. The method of paragraph PCT1, wherein:

the resettable sealing device is positioned downhole from the perforation device;

prior to perforating the first portion of the liner, the method includes contracting the resettable sealing device to a contracted configuration and pulling the stimulation assembly in an uphole direction with the wireline;

the isolating the first portion of the liner includes pumping fluid from the liner conduit into the resettable sealing device to expand the resettable sealing device to a sealing configuration;

prior to perforating the second portion of the liner, the method includes contracting the resettable sealing device to the contracted configuration and pulling the stimulation assembly in the uphole direction with the wireline; and the isolating the second portion of the liner includes pumping fluid from the liner conduit into the resettable sealing device to expand the resettable sealing device to the sealing configuration in a region of the liner that is between the first perforation and the second perforation.

PCT6. The method of paragraph PCT1, wherein the method includes pumping fluid from the liner conduit into the resettable sealing device to expand the resettable sealing device to a motive configuration and providing a motive fluid into the liner conduit to convey the stimulation assembly along the liner conduit.

PCT7. The method of any of paragraphs PCT1-PCT6, wherein, prior to perforating the first portion of the liner, the method further includes:

locating the stimulation assembly within an initial portion of the liner;

perforating, with the perforation device, the initial portion of the liner to create an initial perforation; and introducing the stimulant fluid from the surface region into the liner conduit and through the initial perforation.

PCT8. The method of any of paragraphs PCT1-PCT7, wherein the liner includes at least five portions, and further wherein the method includes repeating the method in each of the at least five portions without removal of the stimulation assembly from the liner conduit.

PCT9. A stimulation assembly for stimulating a subterranean formation that includes a well, wherein the well includes a wellbore and a liner that defines a liner conduit, the stimulation assembly comprising:

a perforation device configured to form one or more perforations within a plurality of portions of the liner;

a resettable sealing device coupled to the perforation device for movement with the perforation device along the liner conduit, configured to isolate an uphole portion of the liner from fluid communication with a downhole portion of the liner, and further configured to direct a stimulant fluid, which is introduced into the liner conduit, and optionally directly into the liner conduit, through one or more perforations that are uphole from the resettable sealing device;

wherein the resettable sealing device is configured to be selectively inflated with fluid from the liner conduit; and wherein the stimulation assembly is coupled to a wireline that provides at least one of a mechanical connection and electrical communication between the stimulation assembly and a surface region.

PCT10. The stimulation assembly of paragraph PCT9, wherein the stimulation assembly includes a pump configured to pump fluid from the liner conduit into the resettable sealing device to inflate the resettable sealing device.

PCT11. The stimulation assembly of paragraph PCT9 or PCT10, wherein the stimulation assembly further includes a motive device that is configured to convey the stimulation assembly along a length of the liner conduit.

PCT12. The stimulation assembly of any of paragraphs PCT9-PCT11, wherein the resettable sealing device is a first resettable sealing device, and further wherein the stimulation assembly includes a second resettable sealing device that is uphole and spaced apart from the first resettable sealing device and coupled to the first resettable sealing device and the perforation device for movement along the liner conduit.

PCT13. The stimulation assembly of any of paragraphs PCT9-PCT12, wherein the stimulation assembly is separably attached to a wiper plug, wherein the wiper plug is located downhole from the resettable sealing device, wherein the well includes a landing collar for the wiper plug, and further wherein the wiper plug is configured to couple to the landing collar, and decouple from the stimulation assembly upon contact with the landing collar.

PCT14. The stimulation assembly of any of paragraphs PCT9-PCT13, wherein the stimulation assembly is configured to form the one or more perforations within each of the plurality of portions of the liner without being removed from the liner conduit, and further wherein the plurality of portions of the liner includes at least five portions of the liner.

PCT15. The stimulation assembly of any of paragraphs PCT9-PCT14, wherein the resettable sealing device includes at least one of a bridge plug, a through tubing bridge plug, a through tubing inflatable bridge plug, a resettable bridge plug, an inflatable bridge plug, an expandable bridge plug, a selectively expandable and contractible bridge plug, and a sealing device that is configured to selectively expand and contract a plurality of times while it is within the liner conduit.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of stimulating a subterranean formation that includes a well, wherein the well includes a wellbore and a liner that defines a liner conduit, the method comprising:

perforating, with a perforation device of a stimulation assembly, a first portion of the liner to create a first perforation, wherein the stimulation assembly includes the perforation device and a resettable sealing device coupled to the perforation device for movement with the perforation device;

isolating, with the resettable sealing device, the first portion of the liner from fluid communication with a first downhole portion of the liner, wherein the isolating the first portion of the liner includes expanding the resettable sealing device to a sealing configuration with fluid from the liner conduit;

introducing a stimulant fluid from the surface region and through the first perforation;

pumping fluid through a fluid conduit and into the resettable sealing device to expand the resettable sealing device to a motive configuration and providing a motive fluid into the liner conduit to convey the stimulation assembly along the liner conduit; and moving the stimulation assembly within the fluid conduit to a second portion of the liner.

2. The method of claim 1, wherein the method further comprises locating the stimulation assembly within the first portion of the liner.

3. The method of claim 1, wherein the method further comprises:

perforating, with the perforation device, the second portion of the liner to create a second perforation;

isolating, with the resettable sealing device, the second portion of the liner from fluid communication with a second downhole portion of the liner, wherein the isolating the second portion of the liner includes expanding the resettable sealing device to a sealing configuration with fluid from the liner conduit; and introducing the stimulant fluid from the surface region and through the second perforation.

4. The method of claim 3, wherein after perforating the first portion of the liner and before perforating the second portion of the liner, the method further comprises locating the stimulation assembly within the second portion of the liner.

5. The method of claim 1, wherein the stimulation assembly is configured to be moved as a unit uphole and downhole within the liner conduit.

6. The method of claim 1, wherein the stimulation assembly is mechanically connected to the surface region via a wireline and is in electrical communication with the surface region via the wireline.

7. The method of claim 1, wherein the resettable sealing device is positioned uphole from the perforation device.

8. The method of claim 1, wherein the resettable sealing device is located downhole from the perforation device.

9. The method of claim 1, wherein the stimulation assembly includes a motive device that is configured to convey the stimulation assembly along a length of the liner conduit, and further wherein the method includes conveying the stimulation assembly along the length of the liner conduit with the motive device.

10. The method of claim 9, wherein, subsequent to perforating the first portion of the liner and prior to isolating the first portion of the liner, the method includes moving the resettable sealing device downhole of the first perforation with the motive device.

11. The method of claim 1, wherein the resettable sealing device is a first resettable sealing device, wherein the stimulation assembly further includes a second resettable sealing device that is uphole and spaced apart from the first resettable sealing device but coupled to the first resettable sealing device.

12. The method of claim 11, wherein the method includes pumping fluid from a fluid conduit into the resettable sealing device to expand the second resettable sealing device to a motive configuration and providing a motive fluid into the liner conduit to convey the stimulation assembly along the liner conduit.

13. The method of claim 12, wherein the method includes contracting the first resettable sealing device to a contracted configuration and pulling the stimulation assembly in an uphole direction with a wireline.

14. The method of claim 12, wherein isolating the first portion of the liner includes pumping fluid from the fluid conduit into the resettable sealing device to expand the second resettable sealing device to a motive configuration, providing a motive fluid into the liner conduit to convey the stimulation assembly downhole until the first resettable sealing device is downhole from the first perforation, contracting the second resettable sealing device to a contracted configuration, and pumping fluid from the fluid conduit into the resettable sealing device to expand the first resettable sealing device to a sealing configuration.

15. The method of claim 1, wherein prior to perforating the first portion of the liner, the method includes contracting the resettable sealing device to a contracted configuration and pulling the stimulation assembly in an uphole direction with a wireline, and further wherein isolating the first portion of the liner includes pumping fluid from a fluid conduit into the resettable sealing device to expand the resettable sealing device to a sealing configuration.

16. The method of claim 15, wherein the method further comprises:

perforating, with the perforation device, a second portion of the liner to create a second perforation;

isolating, with the resettable sealing device, the second portion of the liner from fluid communication with a second downhole portion of the liner; and introducing the stimulant fluid from the surface region, through the fluid conduit, and through the second perforation, and further wherein after isolating the first portion of the liner with the resettable sealing device and prior to perforating the second portion of the liner, the method includes contracting the resettable sealing device to a contracted configuration and pulling the stimulation assembly in an uphole direction with the wireline.

17. The method of claim 16, wherein isolating the second portion of the liner includes pumping fluid from the fluid conduit into the resettable sealing device to expand the resettable sealing device to a sealing configuration in a region of the liner that is between the first perforation and the second perforation.

18. The method of claim 1, wherein the stimulation assembly is separably attached to a wiper plug, wherein the wiper plug is located downhole from the resettable sealing device, wherein the well includes a landing collar for the wiper plug, wherein the method includes providing a motive fluid into the liner conduit to convey the stimulation assembly and the wiper plug downhole and into contact with the landing collar, and further wherein the method includes coupling the wiper plug to the landing collar and decoupling the wiper plug from the stimulation assembly.

19. The method of claim 1, wherein the stimulation assembly includes a pump, and further wherein the isolating includes pumping fluid into the resettable sealing device to expand the resettable sealing device to a sealing configuration.

20. The method of claim 1, wherein, prior to perforating the first portion of the liner, the method further includes:

locating the stimulation assembly within an initial portion of the liner;

perforating, with the perforation device, the initial portion of the liner to create an initial perforation; and introducing the stimulant fluid from the surface region into the liner conduit and through the initial perforation.

21. The method of claim 1, wherein the liner includes at least five portions, and further wherein the method includes repeating the method in each of the at least five portions without removal of the stimulation assembly from the liner conduit.

22. The method of claim 1, wherein the introducing includes at least one of fracturing and acid treating a region of the subterranean formation that is proximal to a perforation through which the stimulant fluid flows.

23. A stimulation assembly for stimulating a subterranean formation that includes a well, wherein the well includes a wellbore and a liner that defines a liner conduit, the stimulation assembly comprising:

a perforation device configured to form one or more perforations within a plurality of portions of the liner;

a resettable sealing device that is coupled to the perforation device for movement with the perforation device within the liner conduit, configured to isolate an uphole portion of the liner from fluid communication with a downhole portion of the liner, and further configured to direct a stimulant fluid, which is introduced into the liner conduit, through one or more perforations that are uphole from the resettable sealing device;

wherein the resettable sealing device is configured to be selectively inflated with fluid from the liner conduit; and a wiper plug positioned downhole from the resettable sealing device, wherein the well includes a landing collar for the wiper plug, wherein the wiper plug is configured to couple to the landing collar and decouple from the stimulation assembly upon contact in the well of the wiper plug with the landing collar.

24. The stimulation assembly of claim 23, wherein the stimulation assembly is coupled to a wireline that provides at least one of a mechanical connection and electrical communication between the stimulation assembly and a surface region.

25. The stimulation assembly of claim 24, wherein the stimulation assembly further includes a motive device that is configured to convey the stimulation assembly along a length of the liner conduit, and further wherein the motive device is configured to be powered via the wireline.

26. The stimulation assembly of claim 23, wherein the resettable sealing device is a first resettable sealing device, and further wherein the stimulation assembly includes a second resettable sealing device that is uphole and spaced apart from the first resettable sealing device and coupled to the first resettable sealing device and the perforation device.

27. The stimulation assembly of claim 23, wherein the stimulation assembly is configured to form the one or more perforations within each of the plurality of portions of the liner without being removed from the liner conduit, and further wherein the plurality of portions of the liner includes at least five portions of the liner.

28. The stimulation assembly of claim 23, wherein the resettable sealing device includes at least one of a bridge plug, a through tubing bridge plug, a through tubing inflatable bridge plug, a resettable bridge plug, an inflatable bridge plug, an expandable bridge plug, a selectively expandable and contractible bridge plug, and a sealing device that is configured to selectively expand and contract a plurality of times while it is within the liner conduit.

29. The stimulation assembly of claim 23, wherein at least one of the resettable sealing device and the stimulation assembly includes a pump that is configured to convey a fluid between an interior of the resettable sealing device and an exterior of the resettable sealing device to selectively expand or contract the resettable sealing device.

30. The stimulation assembly of claim 29, wherein the fluid is a wellbore fluid that is drawn by the pump from within the wellbore.

31. A hydrocarbon well that is configured to convey a hydrocarbon from a subterranean formation to a surface region, the hydrocarbon well comprising:

a liner that defines a liner conduit and provides fluid communication between the subterranean formation and the surface region;

a wellbore that contains the liner; and means for stimulating a plurality of regions of the subterranean formation, wherein the means for stimulating is located within the liner conduit, and further wherein the means for stimulating is configured to stimulate the plurality of regions of the subterranean formation without removal of the means for stimulating from the liner conduit, the means for stimulating comprising:

means for forming one or more perforations within a plurality of portions of the liner; and means for isolating an uphole portion of the liner from fluid communication with a downhole portion of the liner, wherein the means for isolating further includes a means for directing a stimulant fluid, which is introduced into the liner conduit, through one or more perforations that are uphole from the means for isolating, wherein the means for isolating is coupled to the means for forming; and further wherein the means for isolating includes means for selectively inflating the means for isolating with fluid from a fluid conduit; and a wiper plug positioned downhole from the resettable sealing device, wherein the well includes a landing collar for the wiper plug, wherein the wiper plug is configured to couple to the landing collar and decouple from the stimulation assembly upon contact in the well of the wiper plug with the landing collar.

32. The hydrocarbon well of claim 23, wherein the means for forming includes a perforation device.

33. The hydrocarbon well of claim 23, wherein the means for isolating includes a resettable sealing device that is configured to be selectively inflated with fluid from the fluid conduit, and further wherein the means for inflating includes a pump that is configured to pump fluid from the fluid conduit into the resettable sealing device.

* * * * *